US007878445B2

(12) United States Patent
Granger et al.

(10) Patent No.: US 7,878,445 B2
(45) Date of Patent: Feb. 1, 2011

(54) DISPENSER FOR WIPE MATERIALS

(75) Inventors: Maurice Granger, 17 Rue Marcel Pagnol, St. Priest en Jarez (FR) 42270; Erik Hjort, Saeter (SE)

(73) Assignee: Maurice Granger, Saint Priest en Jarez (FR)

( * ) Notice: Subject to any disclaimer, the term of this patent is extended or adjusted under 35 U.S.C. 154(b) by 0 days.

(21) Appl. No.: 12/524,242

(22) PCT Filed: Jan. 23, 2008

(86) PCT No.: PCT/IB2008/000137

§ 371 (c)(1),
(2), (4) Date: Jul. 23, 2009

(87) PCT Pub. No.: WO2008/090442

PCT Pub. Date: Jul. 31, 2008

(65) Prior Publication Data

US 2009/0314875 A1 Dec. 24, 2009

(30) Foreign Application Priority Data

Jan. 24, 2007 (FR) ..... 07 52853

(51) Int. Cl.
*B65H 16/10* (2006.01)

(52) U.S. Cl. ..... 242/564.1

(58) Field of Classification Search ..... 242/560, 242/560.1, 564, 564.1, 564.3, 579, 580
See application file for complete search history.

(56) References Cited

U.S. PATENT DOCUMENTS

| | | | | |
|---|---|---|---|---|
| 6,581,500 | B1 | 6/2003 | Kietaibl | |
| 7,168,602 | B2 * | 1/2007 | Broehl | 242/560.1 |
| 7,182,288 | B2 * | 2/2007 | Denen et al. | 242/560 |
| 2009/0032636 | A1 * | 2/2009 | Orlandi et al. | 242/560.1 |
| 2009/0134265 | A1 * | 5/2009 | Deininger | 242/560.1 |
| 2009/0184193 | A1 * | 7/2009 | Fischer et al. | 242/560.1 |

FOREIGN PATENT DOCUMENTS

| | | |
|---|---|---|
| EP | 1083816 A | 3/2001 |
| FR | 2779049 A | 12/1999 |

OTHER PUBLICATIONS

International Search Report for PCT/IB2008/000137 dated Jul. 7, 2008.

* cited by examiner

*Primary Examiner*—William A Rivera
(74) *Attorney, Agent, or Firm*—Heslin Rothenberg Farley & Mesiti PC

(57) ABSTRACT

A dispensing device for dispensing wiping material includes a feeding mechanism for controlling the dispensing of the web. The feeding mechanism comprises a rotatable drum with a web guide arranged spaced from and surrounding the drum around a major part of its periphery. The web is fed from a first roll, over at least part of an outer surface of the web guide and into the feeding mechanism. An actuator is at least partially supported in a first position by the web, such that, if the first roll is depleted, the actuator is arranged to be displaced into a second position, and to actuate a loader for a second roll.

24 Claims, 18 Drawing Sheets

DISPENSER FOR WIPE MATERIALS

Cross Reference to Related Applications

This application is a national stage filing under section 371 of International Application No. PCT/IB2008/000137 filed on Jan. 23, 2008, and published on Jul. 31, 2008 as WO 2008/090442 and claims priority of French application No. 0752853 filed on Jan. 24, 2007, the entire disclosure of these applications being hereby incorporated herein by reference.

TECHNICAL FIELD

The invention relates to the technical field of dispensers for wipe materials with automatic, semi-automatic or manual dispensing which dispensers have applications for paper hand wipes, general-purpose paper wipes, toilet paper and similar wipes.

BACKGROUND ART

Dispensing machines for wipe materials are widely used. These machines are often of the type comprising a housing that internally accommodates a drum that receives a cutting device which is articulated relative to the drum and during rotation of the latter; the drum is positioned between support side pieces. The roll of material is positioned either resting on the drum or between support side pieces above in the upper part of the housing. A pressure roller is used to press against the drum and allows transport of the web of material towards the back of the machine in order to allow completely safe cutting of the web of material, by above-mentioned cutting device, to a predetermined size. The rolls of material comprise a core that supports the turns of material tightly wound in accordance with the characteristics of the material and market in question. This type of wipe material dispensing machine is generally installed in areas accessible to the public, in areas for company staff or on premises of public sector or private establishments and it is necessary to provide an adequate maintenance organisation to ensure refilling of dispensing machines when the roll of material is exhausted. Faced with the risk of machines that need to be re-filled being effectively put out of service, many technical solutions have been devised making it possible to install a so-called "spare" or "stub" roll of material before the so-called "main", "service" or "supply" roll of material is exhausted. For reasons of clarity, the subsequent text will use the term "stub roll" for a roll that is about to be used up and which is located in a stub roll position. Similarly, the term "main roll" will be used for a full or partially used roll that is located in a main roll or re-fill position, where the main roll is initially placed when re-filling the dispenser. When the stub roll of material is nearly used up it is generally moved by the operator tasked with maintenance towards the bottom rear of the machine with means enabling cutting, depending on the state of the main roll, until it is completely used up by controlling the dispensing of a web of material from the main roll which in turn becomes the stub roll. This is described in several patents such as FR 2 547 716, FR 2 703 343, FR 2 713 075, FR 2 731 608, FR 2 739 545, EP 1 083 816, PCT/FR94/00116 or EP 889 701.

In some cases, transfer and starting of the main roll is initiated by monitoring the stub roll as its diameter reduces, this diameter, for example, acting on transfer means. The stub roll of material that is nearly used up is simply placed in the rear of the machine by the operator who feeds the hanging end of the web of material from the stub roll into the area where the latter is inserted between the drum and the pressure roller and two thicknesses of material are unwound simultaneously until the stub roll is exhausted. There can therefore be wastage, depending on the lengths of the overlapping webs of material taken off from the stub roll and the main roll.

In the solution described in Patent EP 1 083 816, the main roll of material has a hanging free end of material facing the insertion area between the drum and the pressure roller. A flap and rod means making it possible to detect and monitor the weight of the core of the exhausted roll relative to the calibration of a spring, triggers the flap functionality in order to insert the web of material from the main roll between the drum and the pressure roller, this roll in turn becoming the stub roll.

This means is complex and its operation is greatly affected by the particular spring that is chosen to ensure monitoring of the weight of the core of the stub roll that is nearly used up.

The Patent EP 889 701 describes a device for detecting the presence of the web of material from the stub roll when it is nearly used up and when said web is in contact with the drum. To achieve this, the drum is designed with very wide scalloping so that when the last cut-to-size piece of the stub roll escapes, the device swivels, thereby triggering placement of the end of the web from the main roll between the drum and the pressure roller. This swivelling of the device takes place inside the drum.

The problem in this situation with this implementation is the fact that the core of the stub roll that is nearly used up tends to "jump" and come into contact with the area behind the drum and the pressure component, possibly causing the dispensing machine to be put out of service by inopportune jamming. In practice, this solution involves maintenance problems.

The object of the invention is therefore to look for another solution that was more dependable and reliable in terms of functionality.

Another sought-after object of the invention was to ensure an improved storage area for stub rolls that are nearly used up and enable them to be removed easily by the maintenance operative after they are used up.

Another sought-after object of the invention was to monitor depletion of a roll of material that is nearly used up differently and more reliably by monitoring the physical presence of the material from a stub roll that is nearly used up and to trigger placement in use of the main roll in a simple manner.

Another sought-after object of the invention was to limit the presence of a double thickness of material taken from the two rolls (stub roll and main roll) to a single cut—equivalent to one revolution of the drum.

Another sought-after object of the invention was to monitor the position and movement of the core and the stub roll that is nearly used up in order to prevent inopportune movement of the latter and associated risks of the dispensing machine jamming in the event of excessive tensile force being exerted.

Given these objects, the solution devised has involved a wide-ranging rethink of the internal layout of the wipe material dispensing machine and the inclusion of new additional means closely involved in correct operation of the machine during the transitional phase of changeover from the stub roll to the main roll.

These objects and others will become apparent from the following description.

DISCLOSURE OF INVENTION

The invention aims to solve the above problems by providing an improved dispenser as defined by the appended claims.

According to one embodiment of the invention, these objects are achieved by means of a dispensing device for dispensing wiping material which device comprises a housing for holding at least one roll containing a continuous web of wiping material. The housing comprises an outer front wall; two outer side walls and said outer front wall comprises a dispensing opening for the web. The dispenser further comprises a feeding means for controlling the dispensing of the web, wherein the feeding means comprises a rotatable drum with a web guide means arranged spaced from and surrounding the drum around a major part of its periphery. The drum may be any suitable drum or roller having a friction material around at least part of its outer surface in order to feed a web from a main roll to the dispensing opening. The drum may also be provided with a cutting means for cutting the web into desired lengths prior to dispensing.

The web is arranged to be fed from a first roll, which may be a stub roll, over at least part of an outer surface of the web guide means and into the feeding means. The first roll is preferably, but not necessarily, a roll that is about to be depleted, which roll is termed a stub roll. An actuating means is at least partially supported in a first position by the web. If the first roll is depleted, said actuating means is arranged to be displaced into a second position. This displacement of the actuating means causes the actuation of a loading means for a second roll. The second roll may be a main roll that may be placed above the first roll in the dispenser. When re-filling the dispenser, an operator may manually move a partially used main roll, which then becomes a stub roll, into a lower position in the dispenser, from which position the web from the stub roll is continued to be fed until it is depleted. A new second roll, which becomes the new main roll, is placed in an upper position and the leading edge of the second roll is positioned to allow for an automatic roll change when the stub roll is used up.

The actuating means is arranged to cause the leading edge of a second roll to be displaced into the feeding means when the actuating means is displaced to the second position. In order to achieve this, the actuating means is connected to the loading means and that the displacement of the actuating means is arranged to actuate the loading means to move a leading end of a second roll into the feeding means.

The actuating means is preferably, but not necessarily, arranged to be pivoted about an axis during the displacement from the first to the second position. The axis is preferably parallel to the rotary axis of the drum. Also, the actuating means may be spring loaded in the direction of the web guide means, to ensure displacement of the actuating means into the second position upon depletion of the first roll. The actuating means may be provided with at least one projection supported by the web, which projection is arranged to be displaced into a corresponding recess in the web guide means. The at least one projection is arranged to support and maintain the actuating means in the first position as long as the web is being supplied by the first roll. The said projection or projections are arranged to be supported by at least an upper surface of the web which web may in turn be supported by the web guide means. When the web from the first roll is depleted the at least one projection is arranged to drop into a cooperating recess that is preferably, but not necessarily, located in an upper surface of the web guide means. This will cause the actuating means to be displaced from the first to the second position and actuate the loading of the second roll into the feeding means.

According to a first alternative embodiment of the dispensing device, the loading means comprises a first loading means arranged on the actuating means. According to a first example, the actuating means and the first loading means may form an integral unit and are arranged for simultaneous displacement. According to a second example, the first loading means may be mounted onto the actuating means in the form of one or more units. Preferably the loading means are located on a surface of the actuating means facing the feeding means.

In this embodiment the first loading means may comprise at least two projections extending from the actuating means towards the feeding means, which projections are arranged for displacing the leading edge of the second roll into the feeding means. When re-filling the dispenser, the operator may move the partially used second roll from a main roll position into a stub roll position so that the web is continued to be fed from this roll. When relocated to the stub roll position, the second roll becomes the next stub roll, or first roll. The actuating means may be required to be folded away from the web guide means so that the web from the first roll can be placed over the top of the web guide means. When folded back into place, the actuating means will be maintained in its first position by the supporting projections resting on the web from the first roll. A new main roll, that is the new second roll, is then placed in the main roll position, where after the leading edge of the second roll is placed between the projections of the first loading means and the feeding means. At least a portion of the actuating means may be arranged to extend from its pivot axis over at least a portion of an upper surface of the web guide means. In this embodiment the actuating means is preferably arranged on the same side of the drum as the first loading means.

According to a second alternative embodiment of the dispensing device, the loading means comprises a second loading means. In this case, the first roll is located in a receptacle comprising a fixed lower portion and a movable upper portion, wherein the movable upper portion may form part of the actuating means. The upper portion of the receptacle may have an open cylinder configuration, and is mounted rotatable about the ends of the cylinder in the housing of the dispenser. In this way the actuating means can be rotated from the first position to the second position when the first roll is depleted. The cylinder of the upper position may be spring loaded in the direction of the second position.

When re-filling the dispenser, the operator may move the partially used second roll from a main roll position into a stub roll position so that the web is continued to be fed from the first roll. When relocated to the stub roll position, the second roll becomes the next stub roll, or first roll. The movable upper portion of the actuating means may be required to be folded away from the web guide means so that the first roll can be placed in the receptacle and the web from the first roll can be placed over the top of the web guide means. When folded back into place, the actuating means will cover the first roll and be supported in its first position by the at least one supporting projection resting on the web from the first roll. A new main roll, that is the second roll, is then placed in the main roll position, where after the leading edge of the second roll is placed between the second loading means and the feeding means.

One end of the cylinder of the upper portion may be provided with a shaped cam. When rotated by the displacement of the actuating means from the first to the second position, the cam is arranged to control the second loading means to move the leading edge of the second roll into the feeding-means.

The second loading means may include an extended member located in front of the feeding means. This member may be articulated and swivelled by means of a linkage connected to the shaped cam. In order to maintain the second loading means remote from the feeding means when not in use, said member may be actuated against a return spring. The member may have a control edge facing an area where the leading edge of the web of material from the second roll is to be inserted into the feeding means. The inserting of the leading edge of the web may be facilitated by inserting the leading edge between one or more rollers. In this embodiment the actuating means is preferably arranged on the opposite side of the drum relative to the second loading means.

As stated above, the feeding means comprises a rotatable drum with a web guide means arranged spaced from and surrounding the drum around a major part of its periphery. The leading edge of the second roll is to be presented to the feeding means at an exposed part of the drum not covered by the web guide means. Preferably, this exposed part is located along a front or rear surface of the drum in relation to the dispenser housing.

The exposed part of the drum may be provided with at least one roller mounted parallel to the drum, which roller is arranged to assist the leading edge of the web from the second roll into contact with the drum. The location of the axis of at least one roller is preferably, but not necessarily, above a horizontal plane through the axis of the drum. According to an alternative example, the exposed part of the drum may be provided with three rollers mounted parallel to each other and to the drum. These rollers may comprise an upper roller arranged above and adjacent an intermediate roller, allowing a leading edge of the web material to be inserted between the rollers in a perpendicular plane towards the drum. A lower roller may be arranged underneath and adjacent the intermediate roller, allowing the web material to be guided away and removed from the drum.

When the second roll is placed in the main roll, or service, position it may be arranged to be locked against rotation by a supporting means, locking means or similar. One reason for this can be to prevent the leading edge of the second roll from moving out of position. The leading edge of a new main roll should not be displaced past the loading position in front of the drum, as this could interfere with or disrupt the dispensing of the-web-from-the-first-roll.

In order to release the second roll to allow rotation, the displacement of the actuating means may be arranged to release a supporting or locking means in order to load the second roll. A roll loading means for loading the second roll is preferably positioned on the opposite side of the drum relative to the first and loading means for the leading edge of the web. The roll loading means may comprise a linkage, which may comprise a first lever and a second lever, wherein the first lever is arranged to support the second roll in an inactive or locked position. The displacement of the actuating means is arranged to actuate the linkage or levers and displace the second roll into an active position, allowing it to be rotated.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
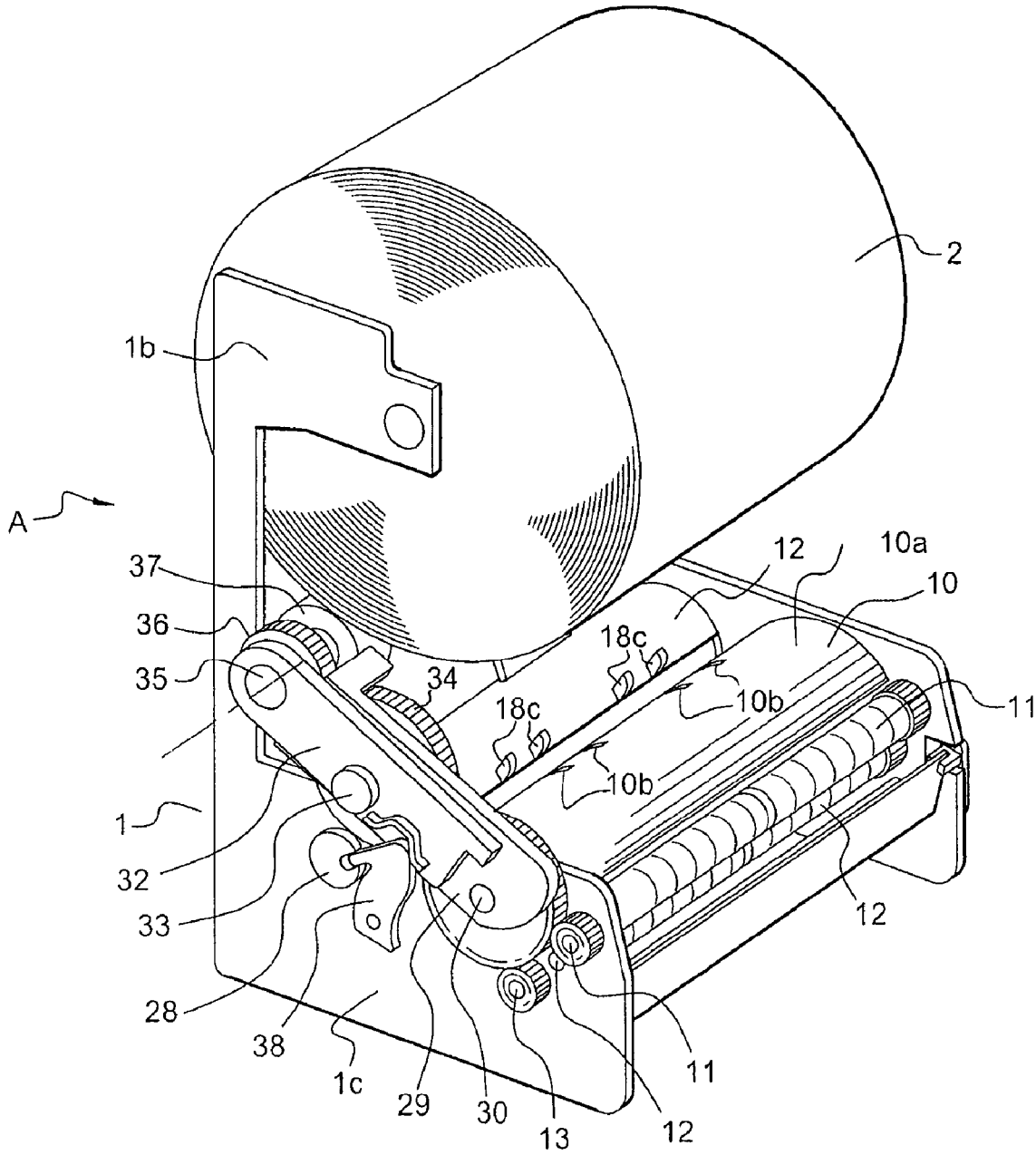
FIG. 1 shows a perspective view of a dispenser according to a first embodiment of the invention loaded with a stub roll.

The wipe material dispensing machine is referred to in its entirety as A and comprises a housing 1 with a back wall 1*a* and lateral sides defining, in the upper part, side pieces 1*b* between which there is a service or standby roll of material 2 and lower side pieces 1*c* between which there is, in particular, a drum 3 accommodating the cutting device which is not shown. This drum is mounted articulated on the above-mentioned receiving side pieces by the ends of its central shaft.

As indicated in the description of the sought-after objects according to the invention, the invention involves designing the wipe material dispensing machine with a storage area Z to receive a stub roll that is nearly used up whilst allowing exhaustion of the roll in question and presentation of the web of material from the standby main roll.

According to the invention, the dispensing machine is designed with a fixed enclosure 10 that partially surrounds the drum over an angle of 180 to 250°, the front part of the drum being freely accessible in order to allow transport and insertion and then ejection of the wipe material before cutting and after cutting. This enclosure is concentric with the drum and leaves, between the enclosure and the drum, a gap I for transport of the wipe material. The ends of this enclosure are fixed on the side piece that supports the drum, either by click-in fastening or bonding or some other method. Depending on fabrication and moulding constraints, enclosure 10 in particular may be moulded integrally with the housing. This enclosure performs several functions that will be described in the rest of this description, firstly it protects the drum and its cutting device, thus providing greater safety for the user, and secondly it defines, by above-mentioned gap I, space for transport and guidance of the material, both these functions relating to the inner part of the enclosure. Externally, wall 10*a* of the enclosure is smooth and is used as a support plane for the web of material from a stub roll that is nearly used up. According to another aspect, this enclosure 10 has, over its length, a plurality of oblong openings 10*b* that are identical to each other and arranged parallel to each other with a predetermined spacing pitch along the enclosure. These oblong openings are made over a sector angle of the order of 15 to 30° approximately and fulfil a precise function. On the front part of the machine and therefore in front of the drum, two embodiments allowing insertion and ejection of the web of material are illustrated in the drawings.

Figure 2:
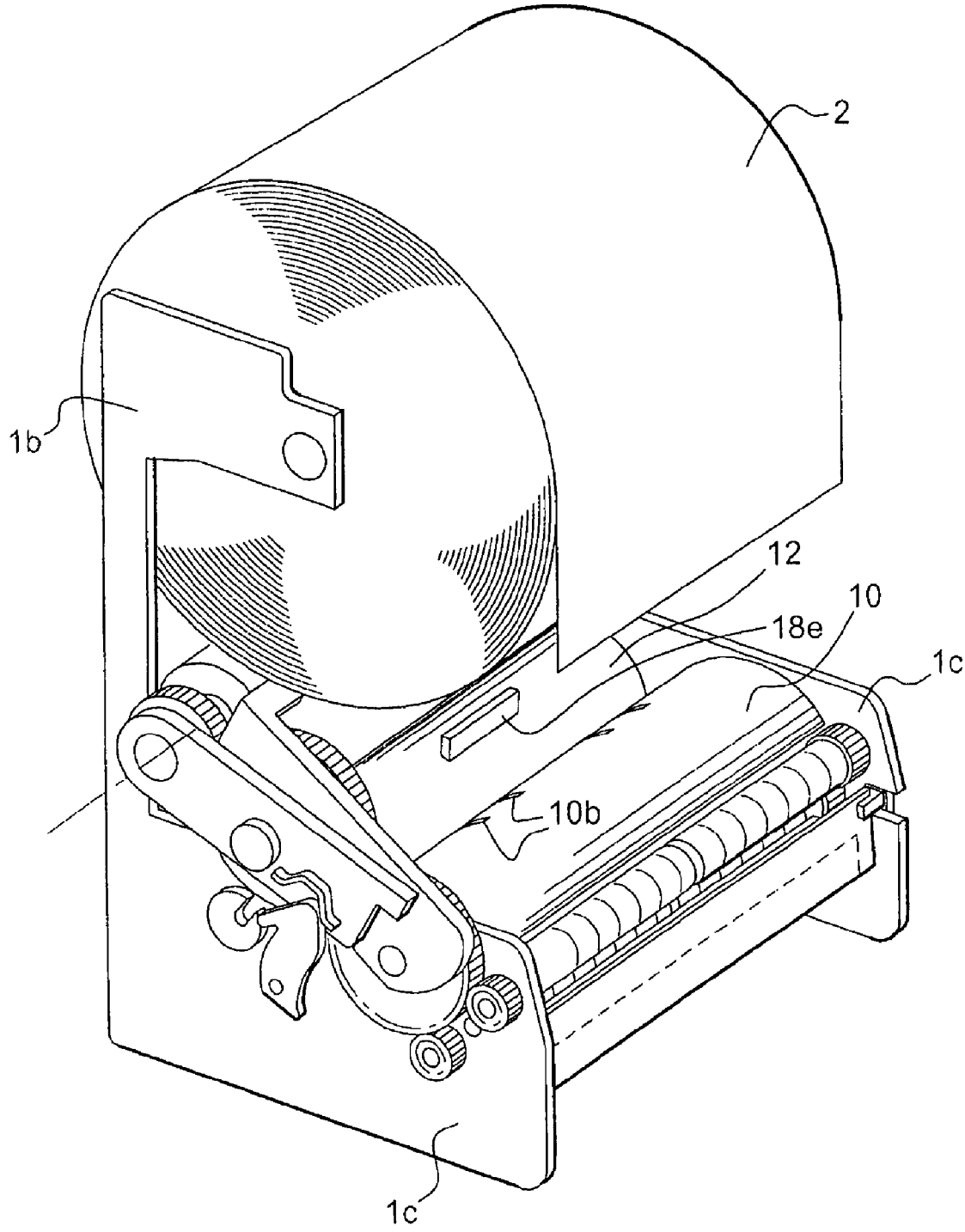
FIG. 2 shows a perspective view of the dispenser of FIG. 1 but with a stub roll placed in a receptacle according to the invention and with the main roll on standby.
Figure 3:
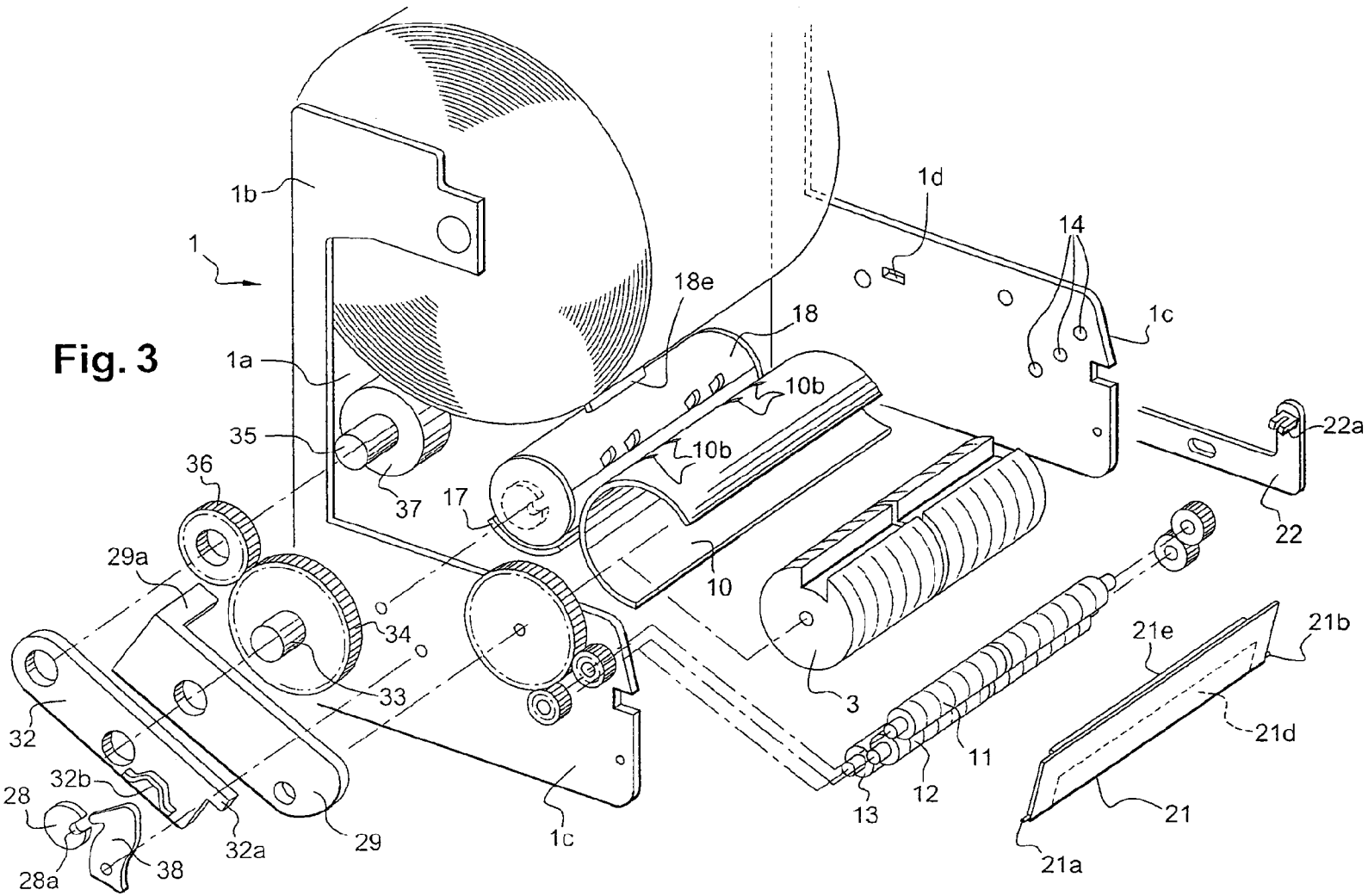
FIG. 3 shows an exploded view of the dispenser including a loading means for the main roll after the stub roll is exhausted.

As shown in FIGS. 1, 2 and 3 for example, three rollers 11, 12, 13 are fitted parallel to each other and have end fingers that penetrate into openings 14 made in the walls of side pieces 1*b* that accommodate the rollers. The rollers are advantageously sheathed in a covering made of an elastomer material and are designed with a plurality of concentric discs along their longitudinal central core that make it possible to define corrugations. Upper roller 11 and intermediate roller 12 are adjacent to each other and make it possible to insert the wipe material in a perpendicular plane so that it is guided towards drum 3. Lower roller 13 underneath intermediate roller 12 is of identical design to the previous two rollers and makes it possible to eject the web of material cut by the cutting device from between the lower roller and the intermediate roller.

Figure 4:
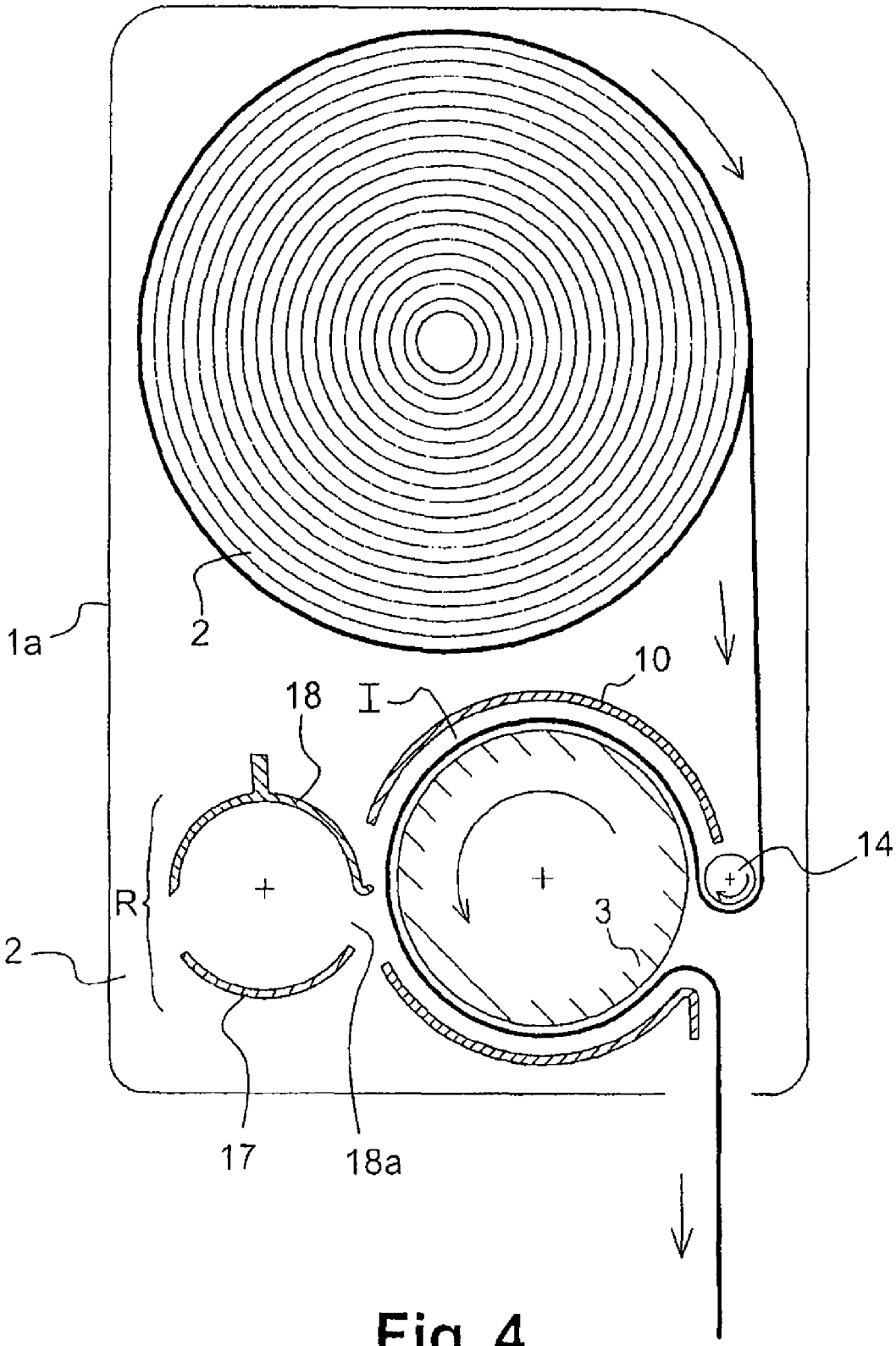
FIG. 4 shows an alternative view of the presentation of the roll of material inside the dispenser according to the invention.
Figure 5:
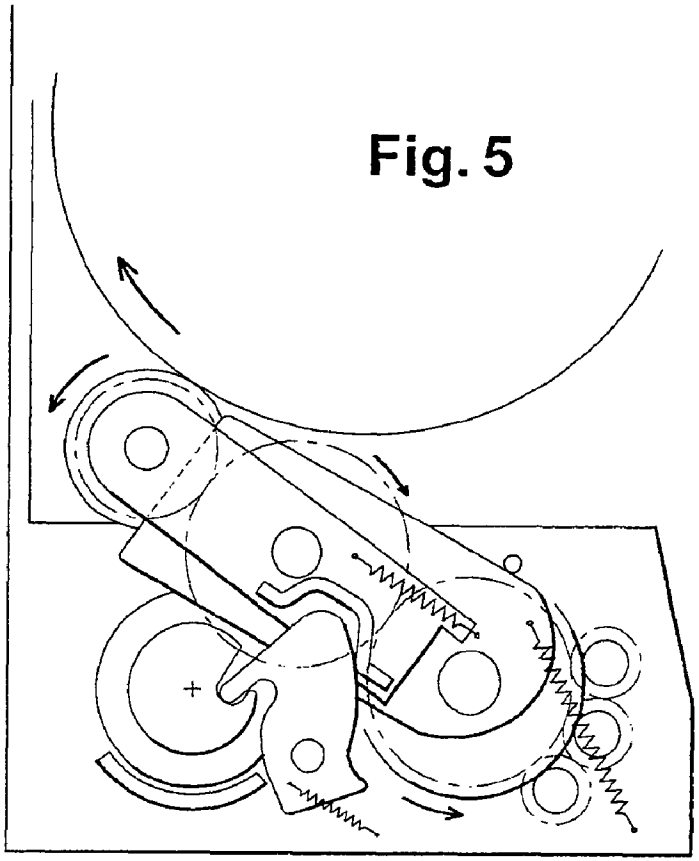
FIG. 5 shows a side view of the dispenser in FIG. 1.

In an alternative embodiment and as shown in FIG. 4, the front part of the machine comprises, beyond said enclosure, a single pressure roller 14 which is mounted articulated relative to the side pieces of the dispensing machine's housing. In this case, the web of material wraps round the pressure roller and is then inserted between said roller and the drum so that it wraps round the drum through the gap I formed between the drum and the fixed enclosure. The cut web of material emerges from the lower part of the machine.

The design arrangements of the receptacle device for a web of material from a stub roll that is nearly used up are now described below.

Figure 12:
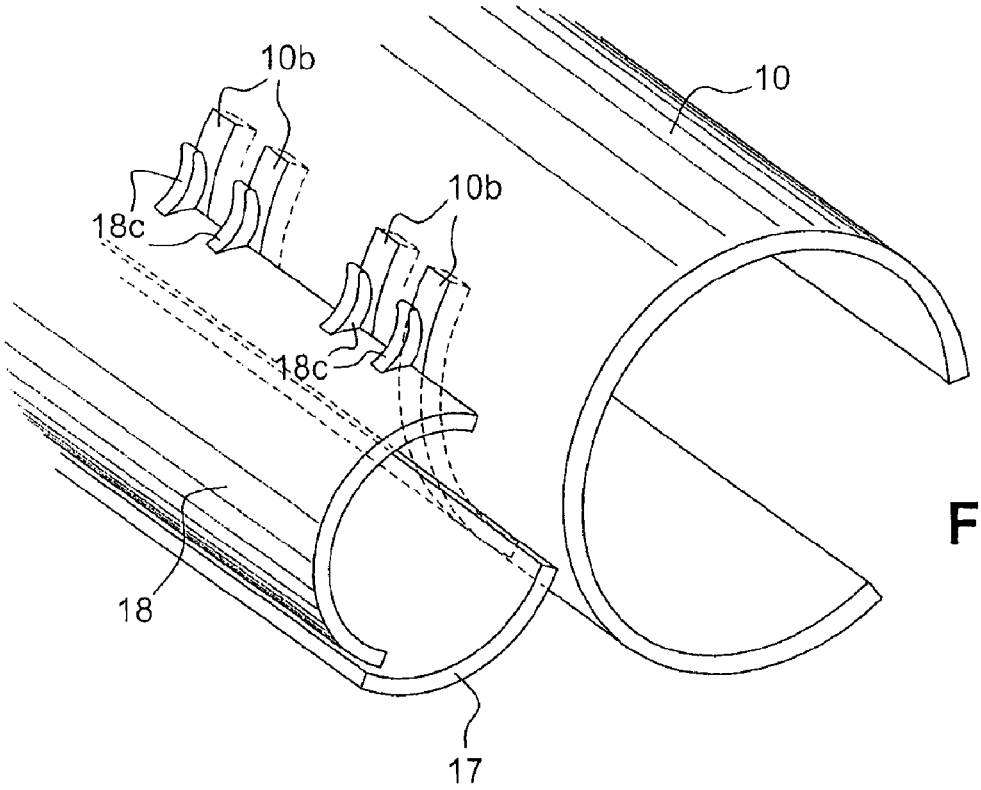
FIG. 12 shows a partial large-scale view of the teeth on the movable component of the receptacle for the stub roll that is nearly used up.
Figure 13:
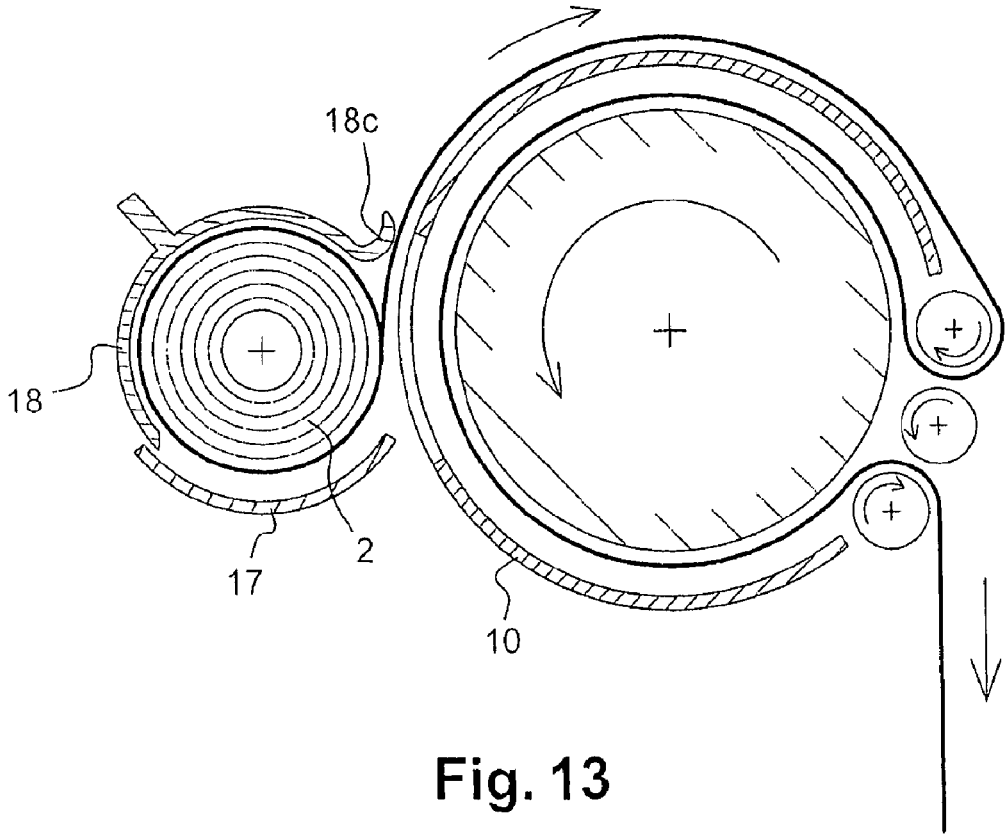
FIG. 13 shows a schematic view of the teeth in FIG. 12.

A receptacle R consisting of two components 17-18 is provided behind the drum and enclosure 10, first component 17 having a fixed position and second component 18 having a movable position. The first component has a curved cradle-like configuration over an angle of approximately 120 to 150° and is oriented with the opening facing towards the top of the machine. Cradle 17 is fixed by click-in fastening, bonding, screw fastening or some other method onto the opposite-facing lower side pieces of the housing. Advantageously, the leading edge of said cradle is tapered. The fixed cradle is intended to receive a stub roll of material that is nearly used up. The second movable component 18 is shown more especially in FIGS. 7 and 8 and has a cylinder configuration. The latter has a very special configuration and is located opposite above-mentioned fixed cradle 17. This cylinder has lateral side pieces with extension shafts and is mounted articulated by its ends on the internal side pieces of the housing in openings made for this purpose. Longitudinally, this cylinder has an opening 18*a* over an angular distance sufficient to allow transport of a stub roll of material which is nearly used up in order to allow access and insertion of the latter into the fixed cradle 17. The cylinder has a smooth wall 18*b* on which there are protruding teeth 18*c* shaped and arranged relative to each other with a spacing pitch identical to that defined for oblong openings 10*b* made in protective enclosure 10 of the drum. These teeth are therefore capable of penetrating into said openings 10*b* in the particular situation where a stub roll of material is exhausted, i.e. after removal of the last cut-to-size piece, as will be explained below. Teeth 18*c* have a straight profile as shown in FIG. 8, but preferably have a curved profile as shown in FIGS. 12 and 13, so that they press against the web of material more effectively. In fact and according to one distinctive feature of the invention, the web of material from a stub roll which is nearly used up and located in the receptacle exits the latter by resting on outer wall 10*a* of enclosure 10 in order to be held between rollers 11-12 on the drum or the pressure roller and the drum, depending on the arrangements of the machine, as indicated previously. Movable cylinder 18 acts as a flap depending on its position relative to the fixed cradle and depending whether or not a web of material is present. To ensure rotation of the cylinder and control of its position, one of the ends 18*f* of the cylinder accommodates, around its end shaft, an elastic positional return means in the form of a hairpin spring 19, one end 19*a* of which is attached to opposite-facing lateral side piece 18*d* of the cylinder and the other end of which is attached to a notch 1*d* made for this purpose on the support side piece. The spring is used in such a way that cylinder 18 swivels forward, i.e. teeth 18*c* penetrate into the mechanical openings on the protective enclosure of the drum. The receptacle cannot be accessed and it contains only a core from the exhausted roll or nothing. When the flap is opened, the return means is tensioned and this corresponds to the presence of a web of material from a stub roll that is nearly used up. The cylinder is rotated manually by the operator tasked with maintenance by pressing on a small flat longitudinal bar 18*e* along the cylinder wall. The small bar is positioned away from said teeth 18*c* at a sufficient distance to be accessible when the cylinder is in the position where the receptacle is closed and teeth 18*c* penetrate into the base of protective enclosure 10.

According to another arrangement of the invention, end 18*f* of cylinder 18 extends as a shaped cam 20 with a notch 20*a* in the shape of a limit stop, the function of which is to control a means for gripping the hanging end of the main roll of material waiting to be loaded on the drum. This loading means comprises a long flap 21 located at the front of the dispensing machine, this flap being articulated and swivelling. To achieve this, flap 21 comprises a first end 21*a* shaped like a finger that penetrates into an opening made on left-hand lateral side piece 1*c* that supports the drum. The other end 21*b* of flap 21 is fixedly mounted on the end forming a head 22*a* of connecting rod 22 located in a plane perpendicular to the flap and laterally parallel to the lower side piece that accommodates the drum and the receptacle. The inner surface of said flap 21 is designed over much of its length with means 21*d* in the form of a clip intended to make it possible to retain the end of the web of material from the main roll. The lower part of this clip is attached to the flap with a certain degree of elasticity in order to allow insertion and then gripping of the web of material. Internally, the flap has a flat strip 21*e* facing the area where the web of material is inserted between rollers

11-12 or between the pressure roller 14 and the drum depending on the chosen configuration.

Connecting rod 22 is freely and controllably coupled to another so-called control rod 23 which is capable of cooperating with cam 20. This control rod 23 has a long horizontal arm 23*a* arranged parallel and adjacent to connecting rod 22. Control rod 23 has, to its rear, a vertical piece 23*b* capable of moving opposite notch 20*a*. The two rods 22-23 are linked to each other, firstly, by two guide fingers 24-25 on the horizontal arm of rod 23 that fit into oblong slots 22*c*-22*d* made in small rod 22 and, secondly, by elastic return means 26 located between rod 22 by attachment finger 27 and finger 28 on piece 23*b*.

Flap 21 is opened in order for the operator to place the end of the web of material from the main roll by actuating head 22*a* of rod 22 and positioning it towards the front, thereby causing extension of return means 26. Once said end of the web is inserted on flap 21 and secured by the clip, release of the flap makes it possible, due to expansion of return means 26, to hold the flap back so as to present the hanging end of the web of material from the reserve roll towards rollers 11-12 or the pressure roller and the drum, depending on the chosen configuration.

The side piece of the housing has a deep notch 27 to allow free movement of the shaft of flap 21 associated with the small rod during the above-mentioned operations.

Another aspect of the invention that involves using the means for loading the main roll positioned on the side of the dispensing machine opposite that which accommodates the means for gripping the hanging end of the main roll is now described below. To achieve this, the other end of cylinder 18 opposite that which accommodates cam 20 for controlling the gripping means, comprises a disc 28 having a notch 28*a* that defines a hook shape 28*b* and an outer ramp 28*c*.

On the internal lateral side piece of the housing, there is a first long lever 29 which is articulated relative to the shaft of the drum. The end of this lever comprises an inwardly oriented perpendicular plate 29*a* that constitutes a support plate for the main roll of material. Lever 29 is articulated relative to a bearing surface 3*a* located on the end of the shaft of the drum and in opposition to elastic return means 30, the other end of which is attached to the bottom of the opposite-facing side piece of the housing. A stop pin 31 is located on the outer surface of the side piece of the housing and limits forward swivelling of said lever. There is another lever 32 adjacent to previous lever 29 that is mounted on a swivel pin 33 with the side piece. This swivel pin is associated with lever 29 in order to support a sprocket 34. The lower part of lever 32 has a heel 32*a* that presses against protruding shaft 33 of the drum. The upper part of lever 32 has an external protruding shaft 35 that accommodates a small-diameter sprocket 36 that cooperates with sprocket 34 then support roller for the roll of material. Roller 37 is located in the same plane as the piece on the end of lever 29. The lower rear part of lever 32 has a cut-out 32*b* and lower ramp-shaped external edge 32*c* to cooperate with a plate that partially forms a hook which, in turn, is capable of cooperating with shaped disc 28 located on the end of the shaft of cylinder 18. Plate 38 has a beak 38*a* capable of cooperating with disc 28 and its matching shapes. The top front edge of plate 38 has a part forming a head 38*b* and ramp 38*c* that cooperate with the matching part of lever 32 and its cut-out during various operating phases. An elastic return means 39 links plate 38 to the lateral side piece of the housing, thus controlling limiting of its displacement. Behind this, spring 40 links lever 32 to lever 29.

The operation of the dispensing machine fitted with the device for receiving rolls and its associated means are explained below.

Firstly, the reader should refer to FIGS. 15 to 20 which explain the principle of the device.

Figure 15:
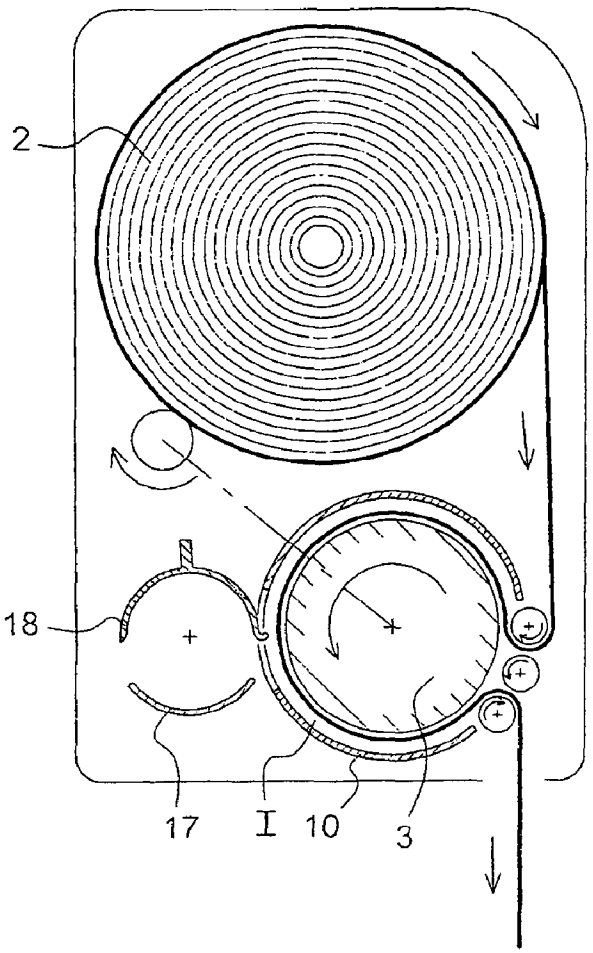

In FIG. 15, the main roll of material is full and the hanging web of material travels between upper roller 11 and intermediate roller 12, goes round the back of the drum in the gap I left between it and protective enclosure 10 and then emerges from the machine from between rollers 12 and 13. Receptacle R is not in use.

Figure 16:
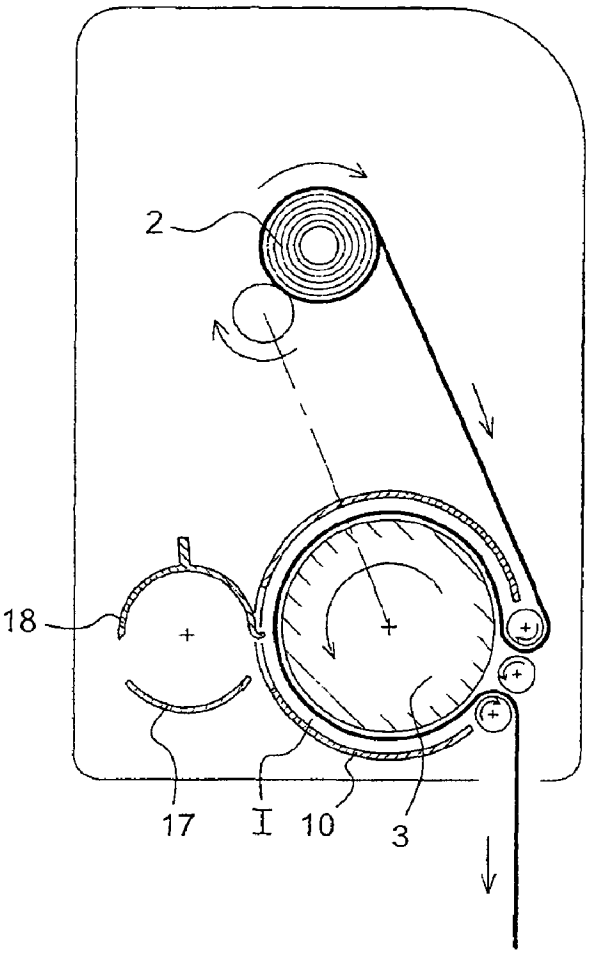
FIGS. 15-20 schematically show the operating principle of the device according to the invention and of its associated means in the dispenser.

In FIG. 16, the situation is the same apart from the fact that the diameter of the main roll of material has already diminished and it must be transferred into receptacle R.

Figure 17:
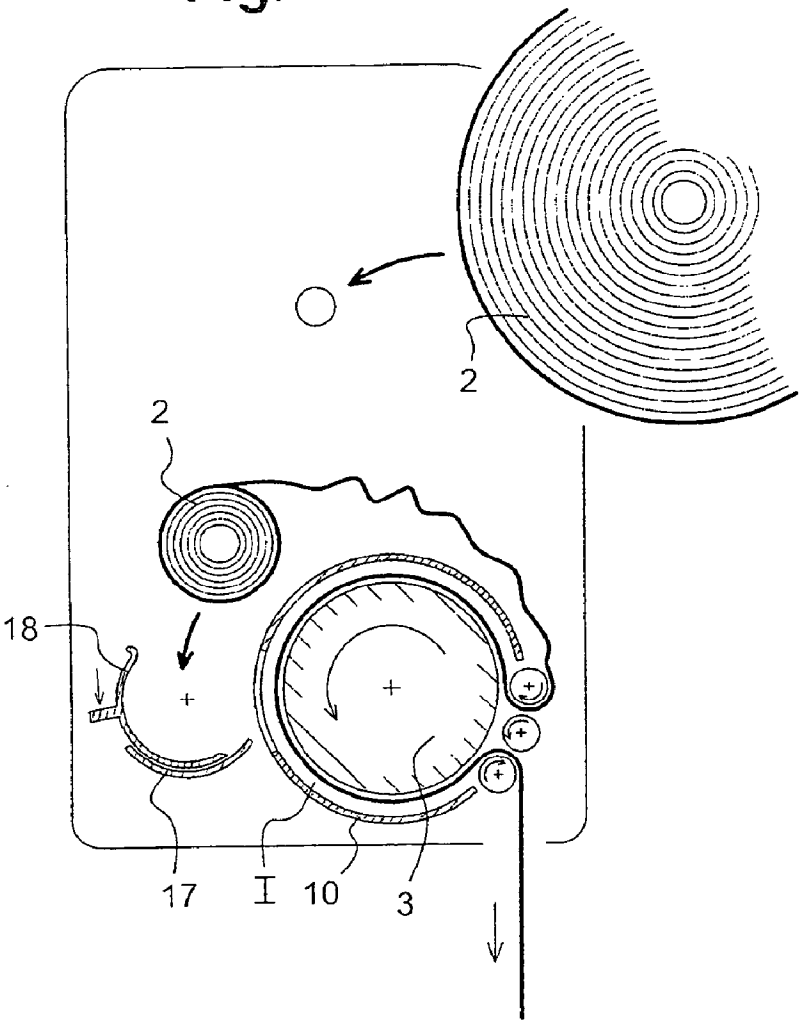

In FIG. 17, said main roll of material has been used up to such a degree that a replacement is required. The main roll is then transferred into the receptacle after opening the latter by actuating movable component 18, whereby the partially used up main roll becomes a stub roll. The web of material will therefore rest on the outside of the protective enclosure of the drum. The operator can, after placement of the stub roll, position a new main roll of material in the dispenser.

Figure 18:
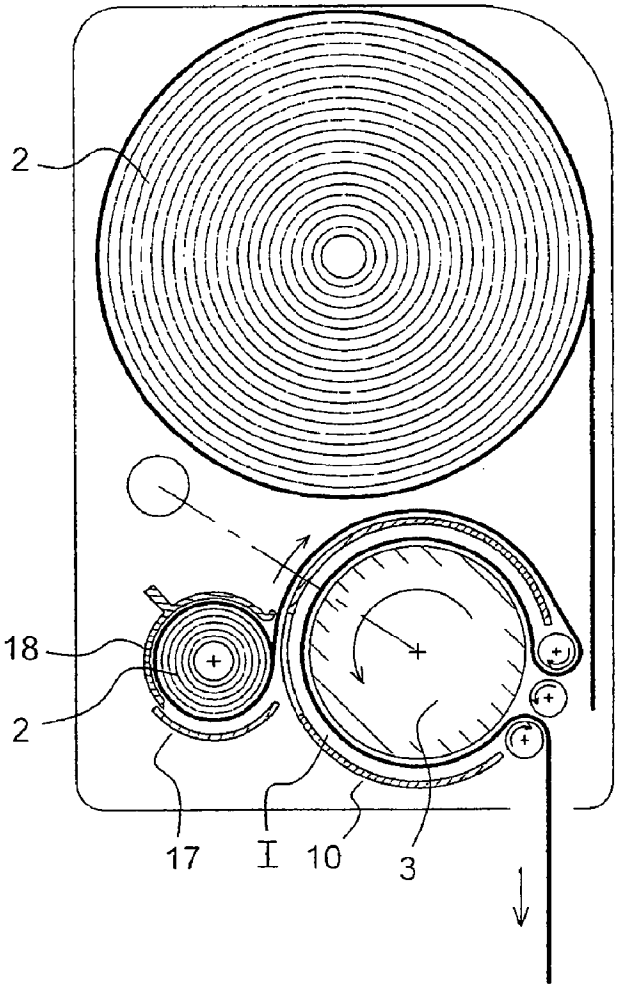

In FIG. 18, the dispensing machine is operating, the end of the web from the main roll is then on standby and movable component 18 of the receptacle rests on the web of material from the stub roll which continues to be unwound. The teeth 18*c* of the movable component 18 press on the opposite-facing web of material which itself rests on enclosure 10.

Figure 19:
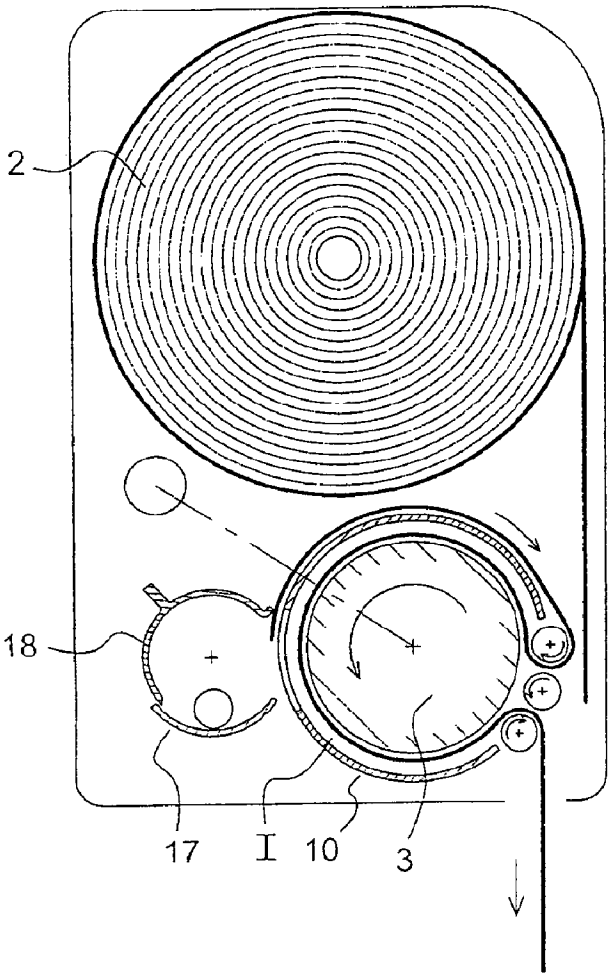

In FIG. 19, the stub roll of material is nearly used up and the final length of material is in the process of being transferred.

Figure 20:
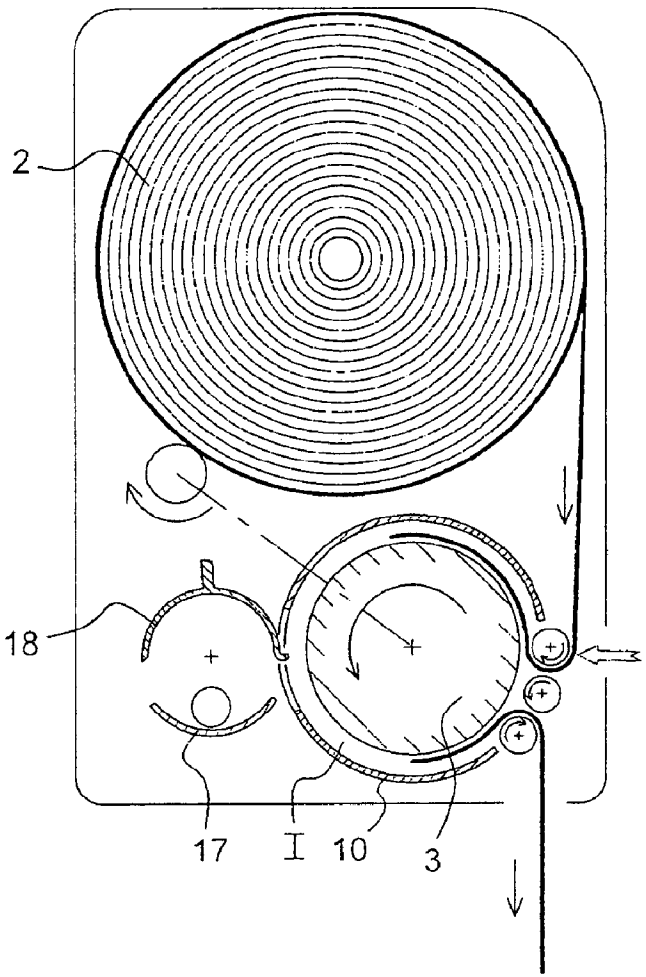

In FIG. 20, the final length of material from the used-up stub roll is removed. The movable component which no longer has any counterforce swivels so that teeth 18*c* penetrate into the openings made in the enclosure. At the same time, swivelling of the movable component triggers, firstly, actuation of the rod means in order to present the flap opposite the gap I where the end of the web of material is inserted between rollers 11-12 or between the pressure roller and the drum depending on the chosen configuration.

Figure 14:
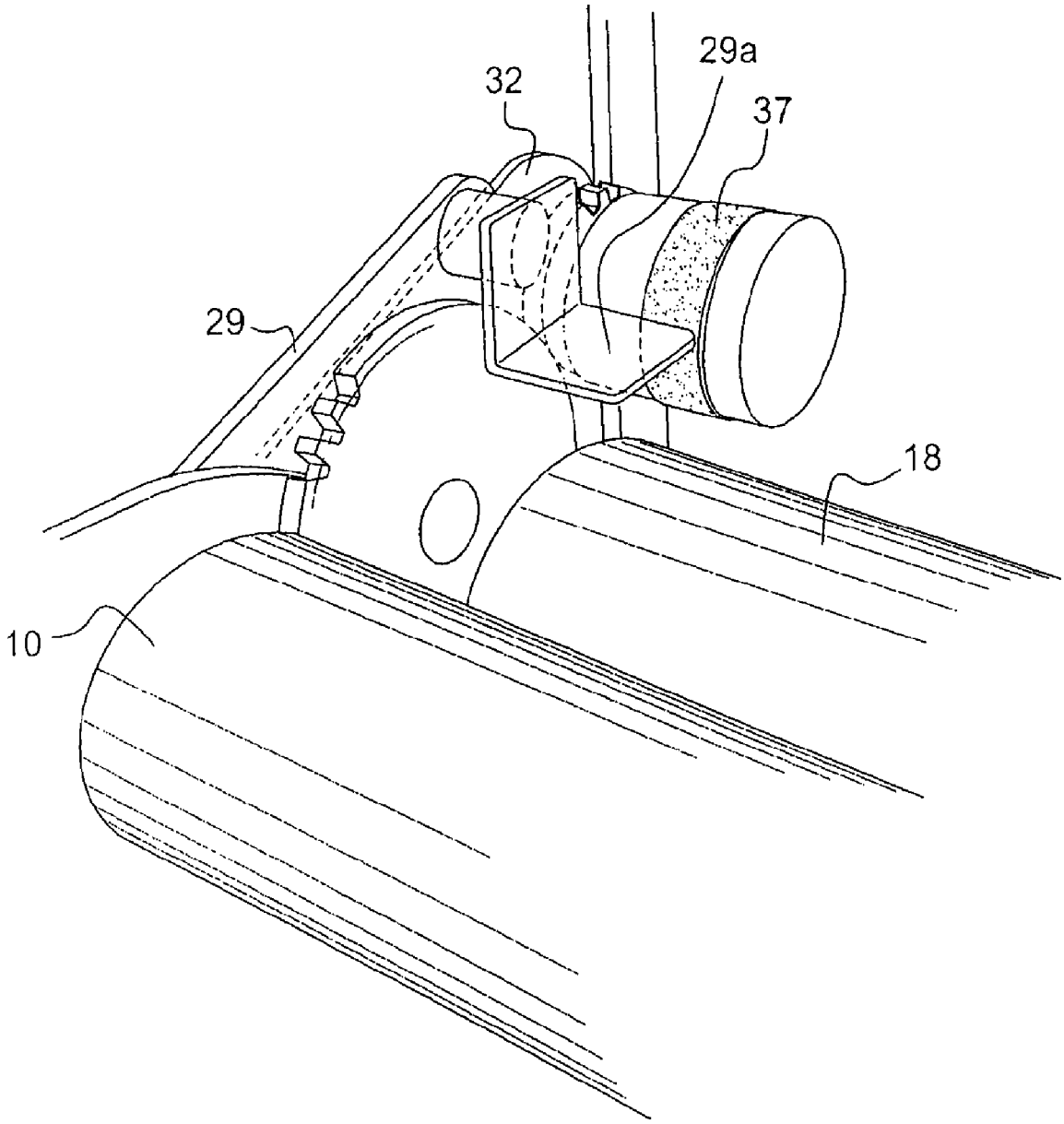
FIG. 14 shows a partial view showing the various support areas of the stub roll or the main roll.

In addition, in the plane in which the main roll is placed, as shown in FIG. 14, the main roll rests on plate 29*a* of lever 29 because the roller associated with lever 32 is retracted. The main roll cannot rotate around its own axis.

Figure 6:
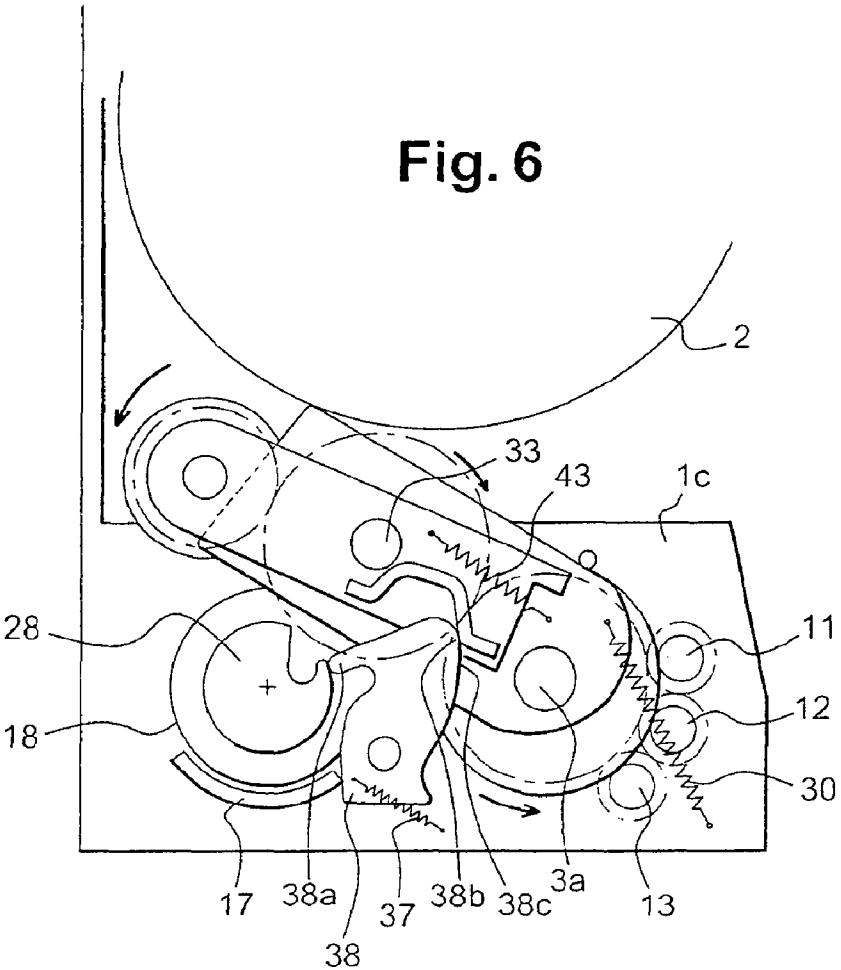
FIG. 6 shows a side view of the dispensing machine in FIG. 2.
Figure 7:
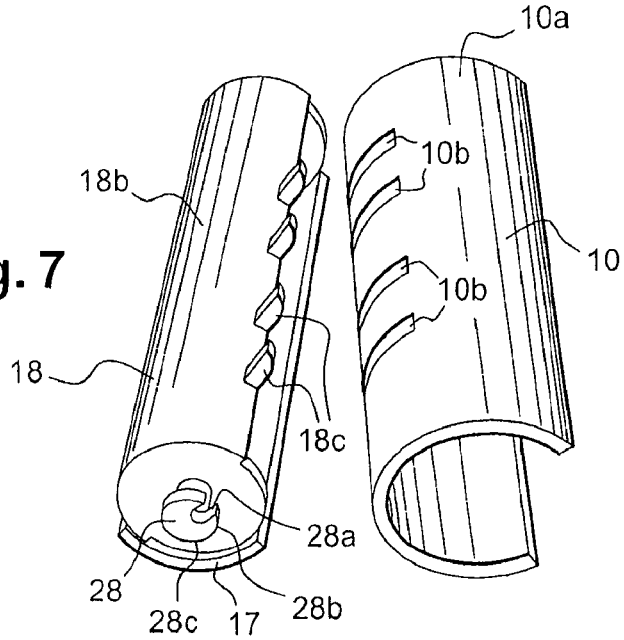
FIG. 7 shows a partial perspective view showing the protective enclosure surrounding the drum of the dispenser and the receptacle capable of receiving a stub roll of material that is nearly used up.
Figure 8:
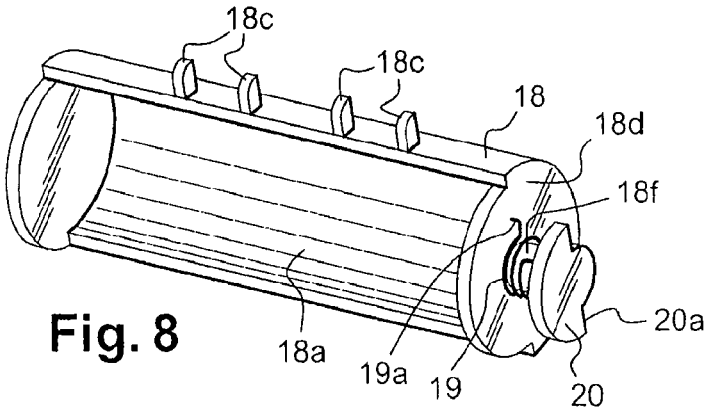
FIG. 8 shows a view of the movable component of the receptacle for receiving a stub roll that is nearly used up.
Figure 9:
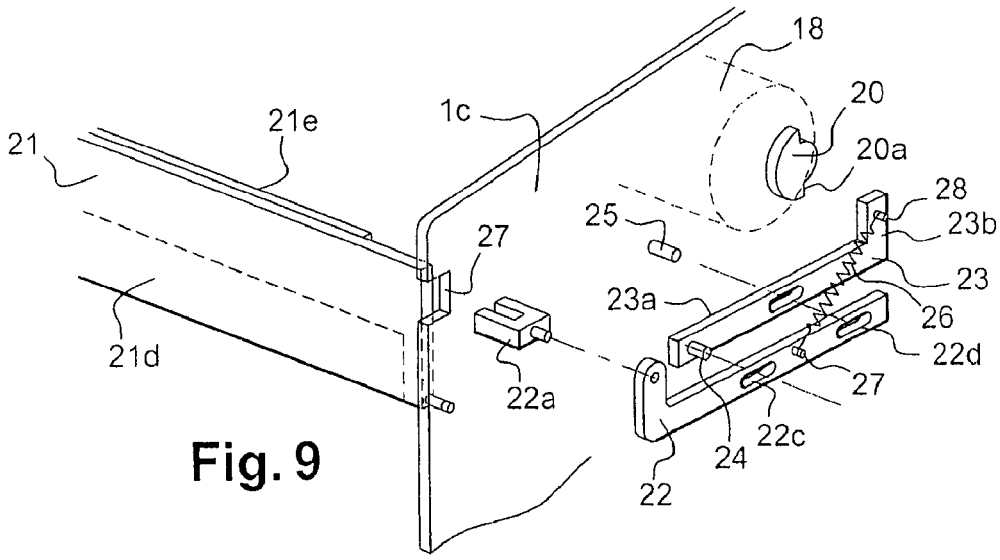
FIG. 9 shows a side view of the dispenser including the means for gripping the end of the web of material from the main roll.
Figure 10:
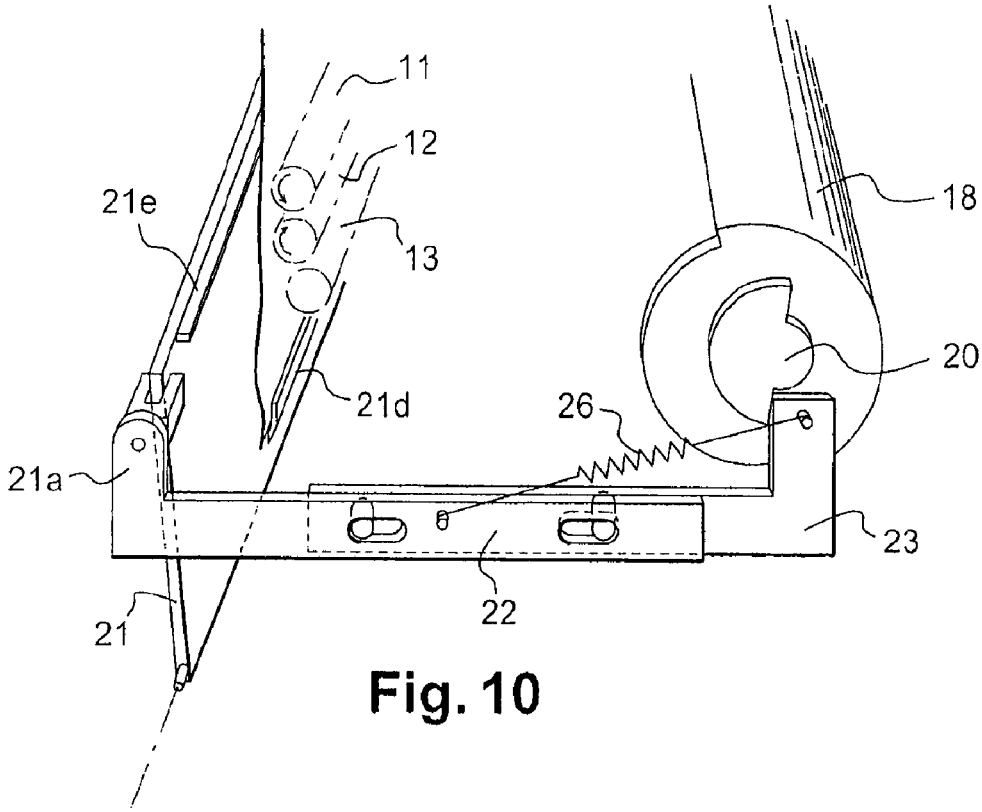
FIG. 10 shows a side view, as in FIG. 9, of the means that ensures gripping of the roll of material before the main roll is actuated.
Figure 11:
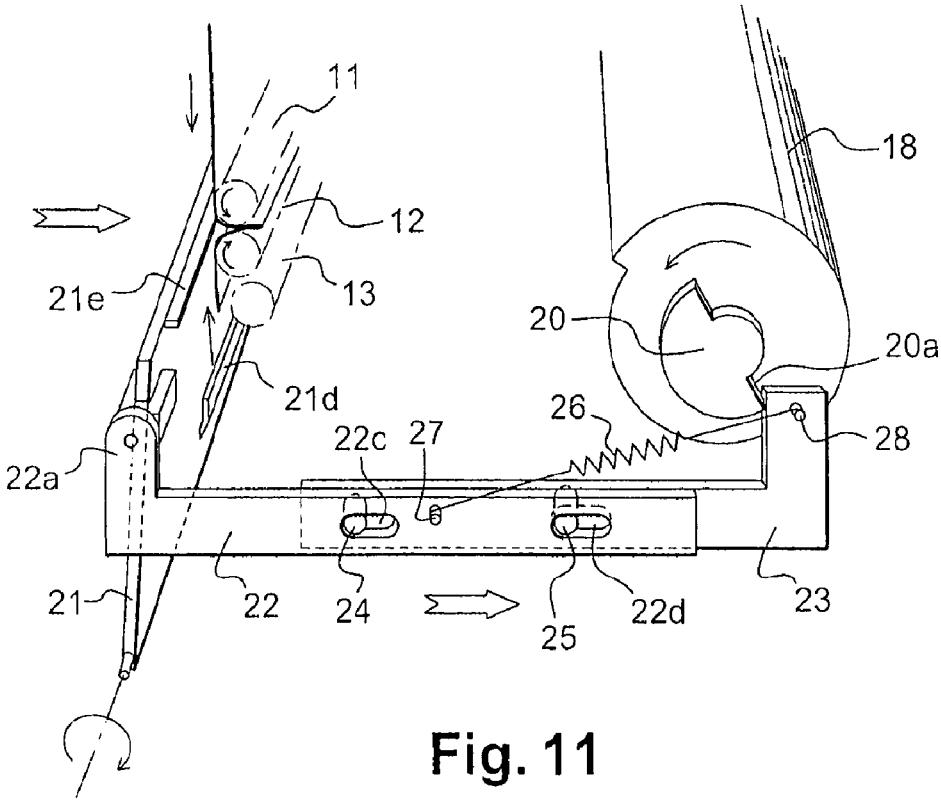
FIG. 11 shows a view as in FIG. 10, after actuation of the main roll and exhaustion of the stub roll located in the receptacle.

Given the large diameter of the main roll, levers 29-32 are swivelled but there is no linkage or retention between the plate and disc 28 associated with movable component 18 (see FIG. 7). In contrast, when the stub roll is exhausted, the movable component swivels and the hook shape 38*a* of the plate 38 is inserted into the notch on the disc 28 (see FIG. 6) and the receptacle is locked in position. The roll 2 of material rests on the roller 37 and can rotate.

According to an alternative embodiment, the roll positions shown in FIGS. 15-20, where the main roll and stub rolls are arranged to be rotated clockwise, may be reversed. In this way, the main roll and the stub roll would be arranged to rotate anti-clockwise in the schematically shown dispenser of FIGS. 15-20. This embodiment would require an additional guide roller (not shown) in front of and below the main roll, in order to guide and suspend the free end of the drum, as shown in FIG. 18. However, the cradle 17 and the movable component 18 can be retained unchanged and the roll changing function would be the same.

Figure 21:
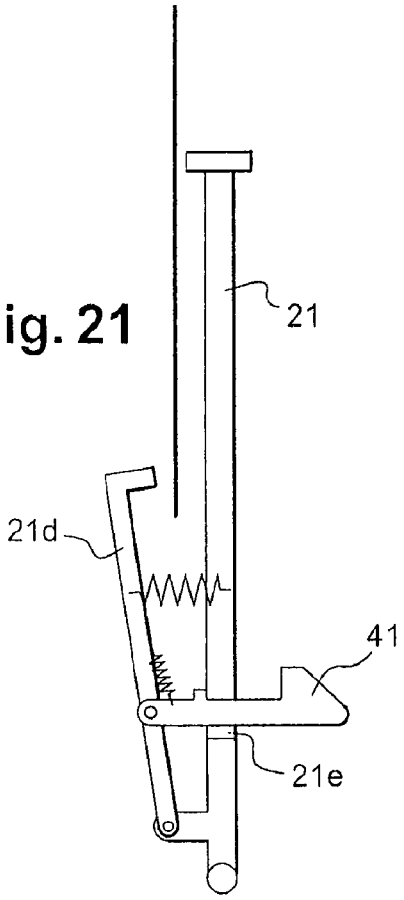
FIG. 21 shows a schematic view showing placement of the web of material from a stub roll in the flap device for presentation to the drum.
Figure 22:
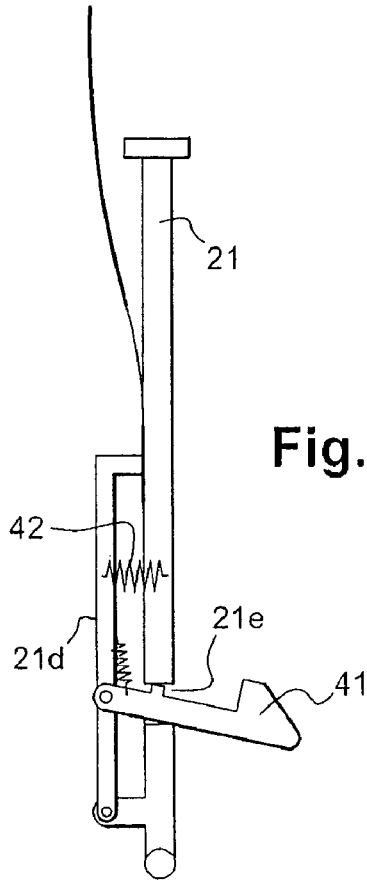
FIG. 22 shows a schematic view as in FIG. 21 after the web of material has been gripped.
Figure 23:
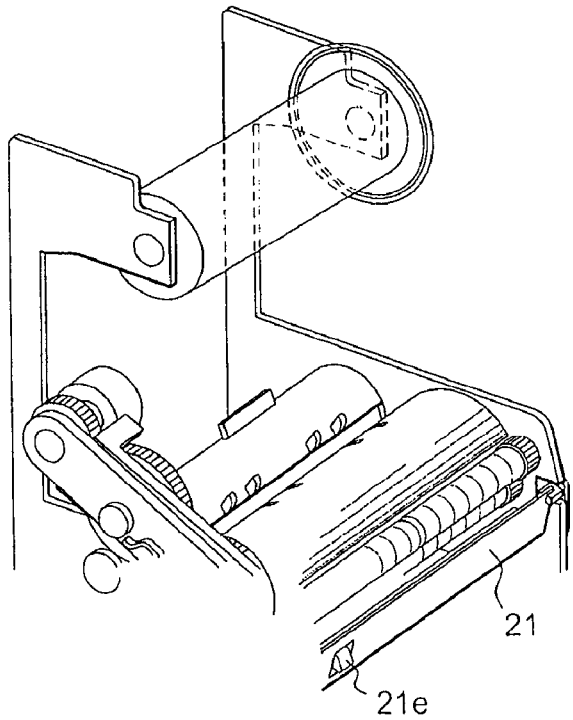
FIG. 23 shows a schematic view showing the flap.

As shown in FIGS. 21 and 22, flap 21 comprises means 21*d* in the form of a clip that is articulated relative to the base of the flap. There is a window 21*e* in the flap that allows movement of a thrust finger 41 and an elastic return means 42 is used to move the clip up against the inner surface of the flap. In FIG.

26, elastic means 42 is a hairpin spring fitted in the lower part of the flap to allow the desired articulation.

Figure 24:
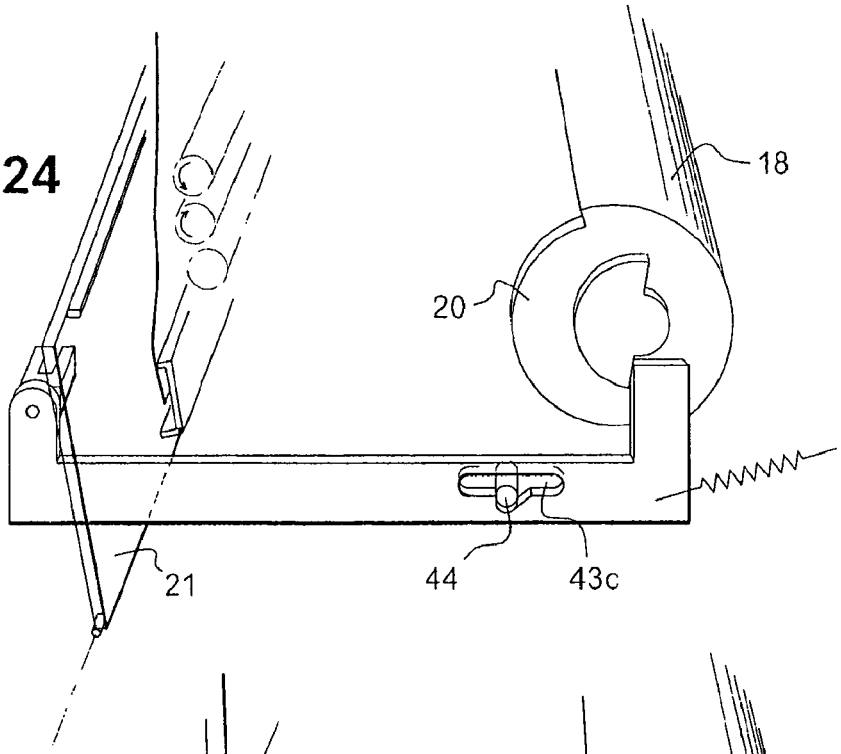
FIGS. 24-25 are alternative views of FIGS. 10 and 11.
Figure 25:
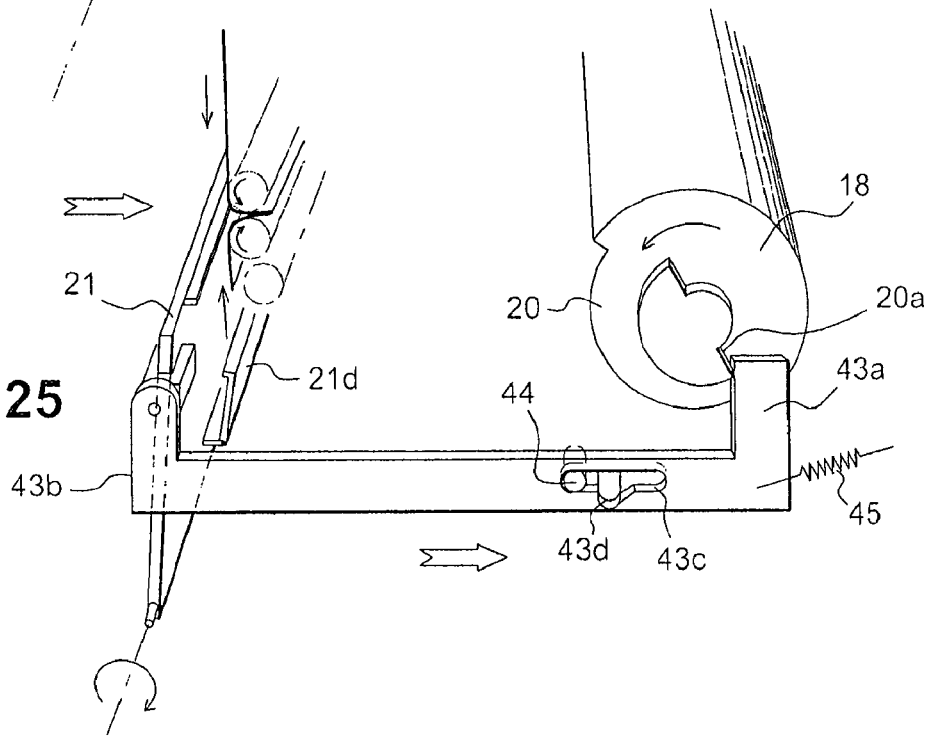
Figure 26:
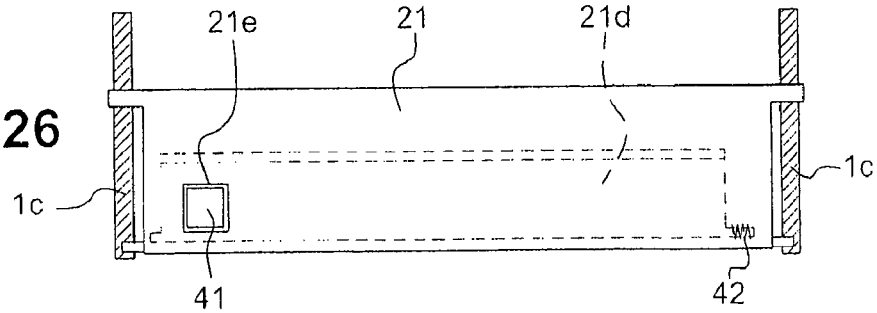
FIG. 26 shows an alternative view of FIG. 22.

In FIGS. 24 and 25, the system for swivelling flap 21 is a single control rod 43, the rear end 43*a* of which cooperates with the heel 20*a* of the cam 20 and the front end 43*b* of which cooperates with the flap 21. The control rod 43 is guided on a single shaft 44 mounted on the side piece with a guide or travel limiting slot 43*c*. This slot 43*c* has one end 43*d* for locking in position on shaft 44 in order to lock the control rod in position when it is translationally moved forward for opening and placing the free end of the roll of material. Return spring 45 returns the control rod to its initial position during locking produced by rotation and actuation of cam 20.

Figure 27:
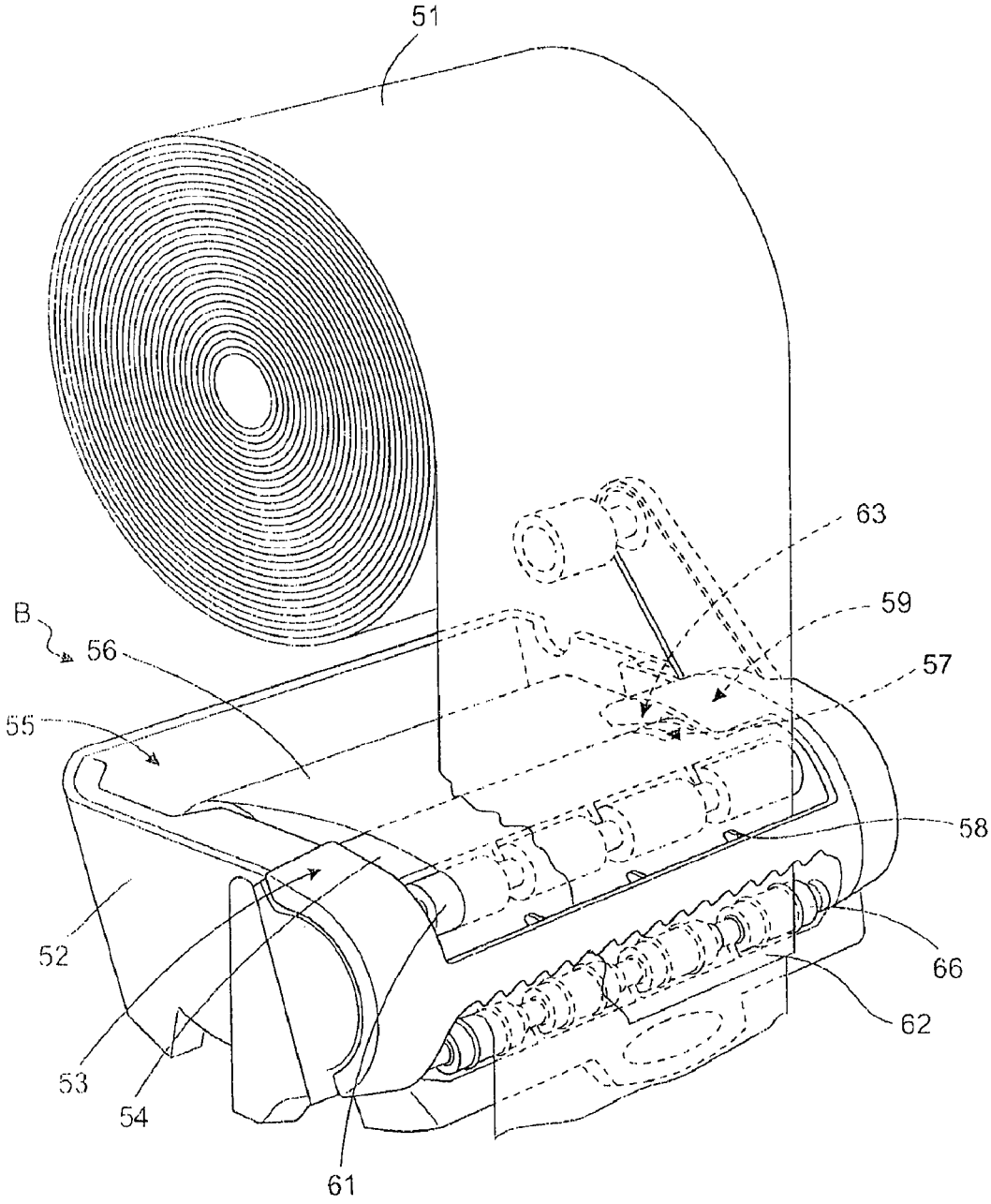
FIG. 27 shows a perspective view of a dispenser according to a second embodiment of the invention.

FIG. 27 shows a first alternative embodiment of the dispensing device according to the invention. The wipe material dispensing machine B comprises a housing (not shown) containing a service or standby roll of material 51 and lower side pieces 52 between which is mounted a drum 53 accommodating a cutting device (not shown). This drum 53 is mounted articulated on a pair of receiving side pieces, as described in connection with FIG. 1, by the ends of its central shaft. In FIG. 27, the drum 53 is mounted inside a fixed enclosure 54.

The wipe material dispensing machine B is provided with a storage area 55 to receive a stub roll 56 that is nearly used up whilst allowing exhaustion of the stub roll 56 in question and presentation of the web of material from the standby main roll 51.

According to the invention, the dispensing machine is designed with said fixed enclosure 54 that partially surrounds the drum 53 over an angle of 180° to 250°. The front part of the drum 53 is freely accessible in order to allow transport and insertion and then ejection of the wipe material before cutting and after cutting. This enclosure 54 is concentric with the drum 53 and leaves, between the enclosure and the drum, a gap I for transport of the wipe material. The ends of this enclosure are fixed on the side piece that supports the drum, either by click-in fastening or bonding or some other method. Depending on fabrication and moulding constraints, enclosure 54 in particular may be moulded integrally with the housing. This enclosure performs several functions that will be described in the rest of this description. First it protects the drum and its cutting device, thus providing greater safety for the user, and secondly it defines, by means of the above-mentioned gap I, a space for transport and guidance of the material, both these functions relating to the inner part of the enclosure. The outer wall of the enclosure 54 is smooth and is used as a support plane for the web of material from the stub roll 56 that is nearly used up. The enclosure 54 is also provided with a plurality of identical and parallel oblong openings 57 arranged at a predetermined spacing pitch along the length of the enclosure 54. These oblong openings 57 are made over a sector angle of the order of 15 to 30° approximately relative to the central axis of the drum 53 and fulfil a precise function.

The dispensing machine is provided with a loading means comprising a first loading means 58 arranged on an actuating means 59. According to a first example, the actuating means 59 and the first loading means 58 form an integral unit and are arranged for simultaneous displacement. According to a second example the first loading means may be removably mounted onto the actuating means in the form of one or more units (not shown). The loading means 58 is located on a surface 60 of the actuating means 59 facing a feeding means 61. In this example, the feeding means 61 is an upper feeding roller arranged to feed a web of material towards the drum 53, into a space between the drum 53 and the enclosure 54. In this embodiment the first loading means comprises three projections 58 extending from the actuating means 59 towards the upper feeding roller 61, which projections 58 are arranged for displacing the leading edge 62 of the service roll 51 into a nip between the upper feeding roller 61 and the drum 53.

When re-filling the dispenser, the operator will move the partially used service roll from a main roll position into a stub roll position so that the web is continued to be fed from this roll. When relocated to the stub roll position, the partially used service roll becomes the next stub roll. The actuating means 59 is folded away from the web guiding enclosure 54 so that the web from the stub roll 56 can be placed over the top of the enclosure 54. When folded back into place, the actuating means 59 will be maintained in its first position by supporting projections 63 resting on the web from the stub roll 56. A new main roll 51 is then placed in the main roll position, where after the leading edge 62 of the new main roll 51 is placed between the projections 58 of the first loading means and the feeding means 61. The actuating means 59 is arranged to extend from a pivot axis 64 over at least a portion of an upper surface of the enclosure 54. The pivot axis is located in front of the drum 53 and below a horizontal plane through its central axis 65. In this embodiment the actuating means is arranged on the same side of the drum as the first loading means.

The operation of the dispensing machine fitted with the device for receiving said main and stub rolls and its associated means are explained below with reference to FIGS. 29 to 30

Figure 28:
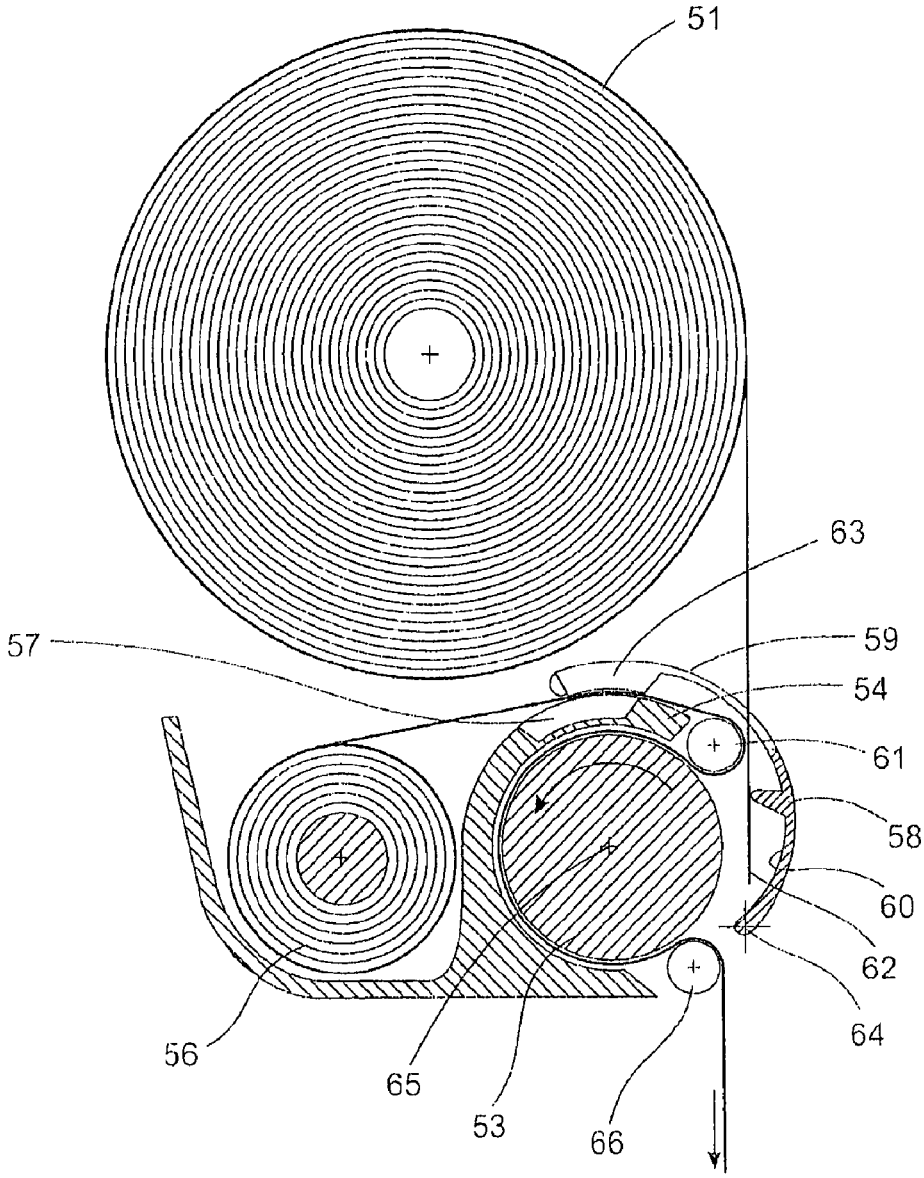
FIGS. 28-30 schematically show the operating principle of the dispenser shown in FIG. 27.

In FIG. 28, the stub roll of material is still in use and the web of material travels over the enclosure 54, over the upper feeding roller 61 and between the upper feeding roller 61 and the drum 53. The web then goes round the back of the drum 53 in the gap I left between the drum 53 and guiding and protective enclosure 54. Finally, the web travels between the drum 53 and a lower feeding roller 66 and emerges from the machine through an opening in the dispenser housing (not shown).

Figure 29:
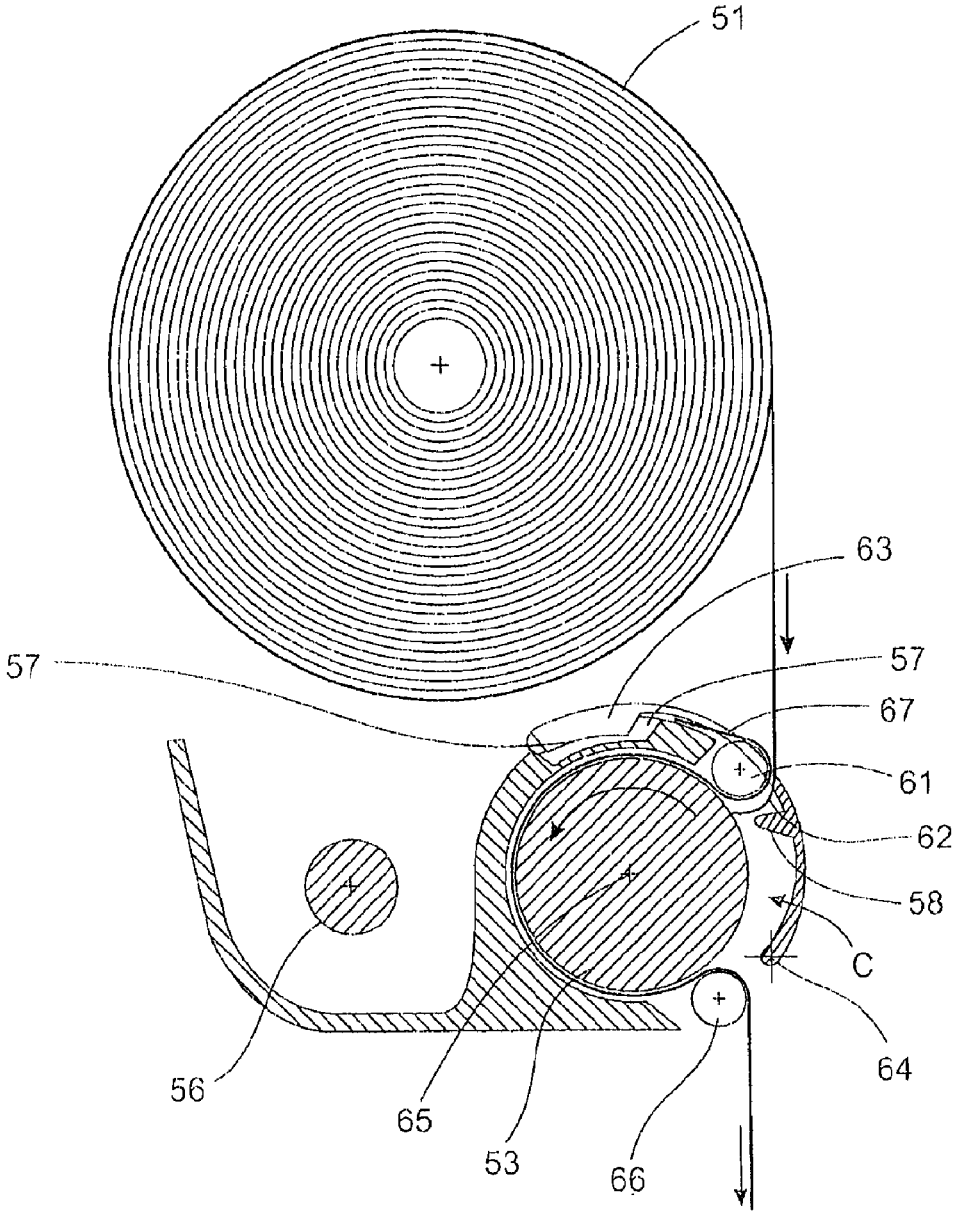

In FIG. 29, the final length of material from the used-up stub roll 56 has just passed over the enclosure 54 and is about to exit the dispenser via the upper feeding roller 61 and the drum 53. When the trailing end 67 of the web from the stub roll 56 passes over the upper surface of the enclosure 54, the supporting projections 63 of the movable actuating means 59 is no longer supported by the said web. The actuating means 59 then swivels about its pivot axis 64, as indicated by the arrow C so that the supporting projections 63 penetrate into the openings 57 made in the enclosure 54. At the same time, swivelling of the actuating means 59 displaces the projections 58 extending from the actuating means 59 towards the upper feeding roller 61 so that the leading end 62 of the web of material from the main roll 51 is inserted between the upper feeding roller 61 and the drum 53.

Figure 30:
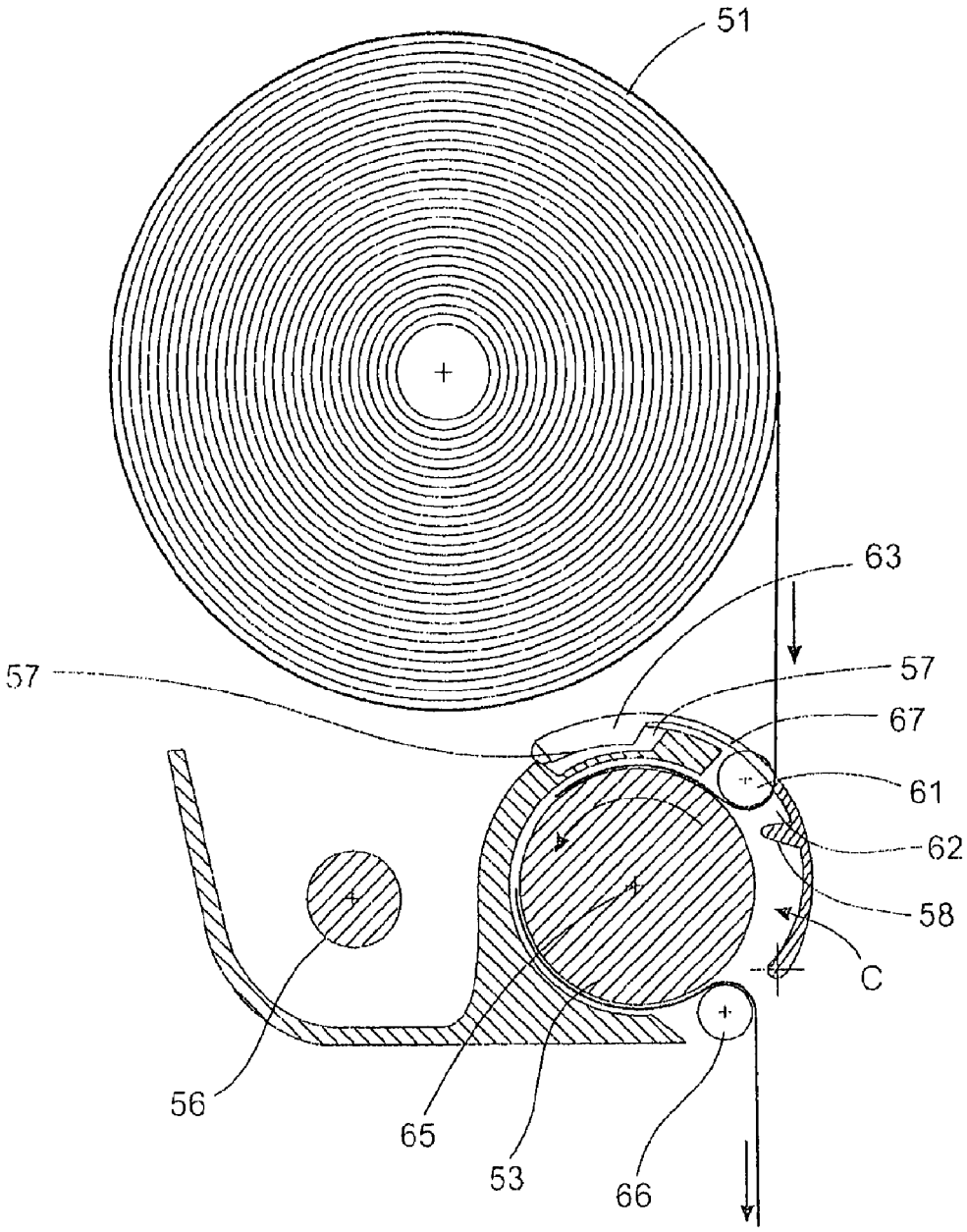

In FIG. 30, the trailing end of the stub roll 56 is exiting the dispenser via the drum 53 and the subsequent wipe material dispensed from the dispensing machine comprises the web from the main roll 51. Wipe material will be continued to be dispensed from the main roll until it is used up to such an extent that it has become a new stub roll, that must be placed in the stub roll receptacle. Consequently, a replacement main roll is again required in the main roll position, as described above.

The solution provided by the invention solves all the problems raised by the prior art easily and effectively.

The invention claimed is:

1. A dispensing device for dispensing wiping material comprising a housing for holding at least one roll containing a continuous web of wiping material, said housing comprising an outer front wall, and two outer side walls, said outer front wall comprising a dispensing opening for the web, the dispenser further comprising a feeding means for controlling the dispensing of the web, wherein the feeding means comprises a rotatable drum with a web guide means arranged spaced from and surrounding the drum around a major part of a periphery of the drum, wherein the web is arranged to be fed from a first roll, over at least part of an outer surface of the web guide means, which outer surface faces away from said drum, and into the feeding means, an actuating means is at least partially supported in a first position by the web supplied by the first roll, and, if the first roll is depleted, said actuating means is arranged to be displaced into a second position, and to actuate at least a first loading means for a second roll, the actuating means comprising an open cylinder mounted rotatably about ends of the cylinder in the housing, and wherein one end of the cylinder is provided with a shaped cam, which, when rotated by displacement of the actuating means, is arranged to control a second loading means to move a free end of the second roll into the feeding means.

2. A dispensing device according to claim 1, wherein the actuating means is arranged to cause a leading edge of the second roll to be displaced into the feeding means when displaced to the second position.

3. A dispensing device according to claim 2, wherein the first roll is located in a receptacle comprising a fixed lower portion and a movable upper portion.

4. A dispensing device according to claim 3, wherein the movable upper portion comprises the actuating means.

5. A dispensing device according to claim 1, wherein the actuating means is connected to a first loading means and displacement of the actuating means is arranged to actuate the first loading means to move a leading end of the second roll into the feeding means.

6. A dispensing device according to claim 5, wherein the first loading means is arranged on the actuating means.

7. A dispensing device according to claim 6, wherein the actuating means and the first loading means form an integral unit and are arranged for simultaneous displacement.

8. A dispensing device according to claim 6, wherein the first loading means comprises at least two projections extending from the actuating means towards the feeding means, which projections (58) are arranged for displacing the leading edge of the second roll into the feeding means.

9. A dispensing device according to claim 6, wherein the leading edge of the second roll is placed between the first loading means and the feeding means.

10. A dispensing device according to claim 6, wherein at least a portion of the actuating means is arranged to extend over an upper surface of the web guide means.

11. A dispensing device according to claim 6, wherein the actuating means is arranged on a same side of the drum as the first loading means.

12. A dispensing device according to claim 1, wherein the actuating means is arranged to be pivoted about an axis.

13. A dispensing device according to claim 1, wherein the actuating means is spring loaded in a direction of the web guide means to ensure displacement of the actuating means upon depletion of the first roll.

14. A dispensing device according to claim 1, wherein the actuating means has at least one projection supported by the web, which projection is arranged to be displaced into a corresponding recess in the web guide means.

15. A dispensing device according to claim 1, wherein the second loading means includes an extended member located in front of the feeding means, said member being articulated and swivelling by a linkage connected to the shaped cam, said member acting against a return spring.

16. A dispensing device according to claim 15, wherein, the member has a control edge facing an area where a leading edge of the web of material from the second roll is to be inserted between one or more rollers.

17. A dispensing device according to claim 1, wherein the actuating means is arranged on an opposite side of the drum relative to the second loading means.

18. A dispensing device according to claim 1, wherein an exposed part of the drum is provided with at least one roller mounted parallel to the drum.

19. A dispensing device according to claim 18, wherein the exposed part of the drum is provided with three rollers mounted parallel to each other and to the drum.

20. A dispensing device according to claim 18, wherein the at least one roller comprise an upper roller arranged above and adjacent an intermediate roller, allowing a leading edge of the web material to be inserted between the rollers in a perpendicular plane towards the drum.

21. A dispensing device according to claim 20, wherein a lower roller is arranged underneath and adjacent the intermediate roller allowing the web material to be removed from the drum.

22. A dispensing device according to claim 1, wherein a roll loading means for loading the second roll is positioned on an opposite side of the drum relative to loading means for loading the first roll.

23. A dispensing device according to claim 22, wherein the roll loading means comprises a linkage having a first lever and a second lever, wherein the first lever is arranged to support the second roll in an inactive position.

24. A dispensing device according to claim 23, wherein a displacement of the actuating means is arranged to actuate the levers and displace the second roll into an active position, allowing it to be rotated.

* * * * *